US007237689B2

(12) United States Patent
Maggio, Sr. et al.

(10) Patent No.: US 7,237,689 B2
(45) Date of Patent: Jul. 3, 2007

(54) MOLDED PLASTIC WASTE CONTAINER WITH INTEGRAL SIDE CHANNELS FOR RECEIVING LIFTING PRONGS AND METHOD

(75) Inventors: Richard A. Maggio, Sr., Laguna Hills, CA (US); Ronald C. Pearson, Capo Beach, CA (US)

(73) Assignee: Global Distributors LLC, Laguna Hills, CA (US)

( * ) Notice: Subject to any disclaimer, the term of this patent is extended or adjusted under 35 U.S.C. 154(b) by 0 days.

(21) Appl. No.: 11/060,940

(22) Filed: Feb. 18, 2005

(65) Prior Publication Data

US 2006/0060593 A1 Mar. 23, 2006

Related U.S. Application Data

(60) Provisional application No. 60/610,724, filed on Sep. 17, 2004.

(51) Int. Cl.

| | |
|---|---|
| ***B65D 6/00*** | (2006.01) |
| ***B65D 8/04*** | (2006.01) |
| ***B65D 8/18*** | (2006.01) |
| ***B65D 90/02*** | (2006.01) |

(52) U.S. Cl. ..... 220/675; 220/1.5; 220/908

(58) Field of Classification Search ..... 220/908, 220/1.5, 675; 292/302, 300, 341.15

See application file for complete search history.

(56) References Cited

U.S. PATENT DOCUMENTS

| | | | | |
|---|---|---|---|---|
| 814,563 | A * | 3/1906 | Pond | 220/476 |
| 3,214,506 | A | 10/1965 | Corbin, Jr. | |
| 3,643,993 | A * | 2/1972 | Asadurian | 294/68.26 |
| 3,840,141 | A | 10/1974 | Allom et al. | |
| 4,214,670 | A | 7/1980 | Berger et al. | |
| 4,456,141 | A * | 6/1984 | Pamment | 220/254.5 |
| 4,550,849 | A * | 11/1985 | Adsit | 220/645 |
| 4,726,616 | A * | 2/1988 | Schmidt | 294/68.2 |
| 4,913,301 | A * | 4/1990 | Pickler | 414/403 |
| 4,955,501 | A * | 9/1990 | Hodge | 220/315 |
| 5,105,967 | A * | 4/1992 | Horpestad | 220/817 |
| 5,183,180 | A * | 2/1993 | Hawkins et al. | 294/68.1 |
| 5,330,071 | A * | 7/1994 | Parker | 220/645 |
| 5,423,448 | A * | 6/1995 | Pedigo | 294/68.2 |
| 5,538,158 | A | 7/1996 | Prout et al. | |
| 5,582,322 | A | 12/1996 | Prout et al. | |
| 5,776,405 | A | 7/1998 | Prout et al. | |
| 5,886,068 | A | 3/1999 | Prout et al. | |
| 5,922,267 | A * | 7/1999 | Brescia et al. | 264/310 |
| 6,632,064 | B1 * | 10/2003 | Walker et al. | 414/406 |
| 6,676,175 | B2 * | 1/2004 | Jaeb et al. | 292/116 |
| 6,702,135 | B2 * | 3/2004 | Pickler | 220/1.5 |
| 2002/0030335 | A1 * | 3/2002 | Moore | 280/33.995 |
| 2002/0125151 | A1 * | 9/2002 | Samsel | 206/278.1 |

OTHER PUBLICATIONS

Portion of Pacific Compactor Corp.'s website showing waste containers.

Portion of Cascade Engineering's website showing waste containers.

Portion of a Nuwave Container Inc.'s brochure showing rotational molded plastic waste containers with steel side pockets and steel hinge brackets for mounting the lid.

Prior art waste container described in Craig Pearson's declaration dated Oct. 19, 2005—4 photos enclosed.

* cited by examiner

*Primary Examiner*—Anthony D. Stashick
*Assistant Examiner*—Harry A. Grosso
(74) *Attorney, Agent, or Firm*—Thomas C. Wettach, Esq.; Cohen & Grigsby, P.C.

(57) ABSTRACT

A plastic waste container is rotationally molded with a hollow material carrying or holding compartment having a bottom, rear, front and opposed side walls. A plastic pocket defining a prong receiving channel, located on each side wall, is integrally formed with the compartment, i.e., molded therewith or premolded and subsequently bonded thereto. Preferably a skirt, extending around each of the pockets, is integrally molded with the compartment and includes struts extending along the side walls of the compartment, above and below the pockets.

13 Claims, 29 Drawing Sheets

MOLDED PLASTIC WASTE CONTAINER WITH INTEGRAL SIDE CHANNELS FOR RECEIVING LIFTING PRONGS AND METHOD

RELATED APPLICATION

This application claims priority of U.S. Provisional Application Ser. No. 60/610,724, filed Sep. 17, 2004, the contents of which are incorporated herein by reference.

FIELD OF THE INVENTION

This invention relates to molded open mouth plastic containers and more particularly to waste containers having integral plastic side channels for receiving the prongs of a lifting mechanism whereby the containers can be readily lifted and the contents therein emptied into a suitable depository. The invention further relates to a rotational molding process for manufacturing such containers.

BACKGROUND OF THE INVENTION

Rotational molding involves a process for producing generally hollow, seamless plastic products. Its greatest use has been for thermoplastic materials in which a powder or liquid polymer is placed in a mold with the mold being heated and rotated simultaneously about two perpendicular axes, i.e., biaxially. Polyethylene or polypropylene are the most common thermoplastic materials in use.

When using a powdered material, the powder, in coming into contact with the heated rotating mold surface, melts and adheres thereto. As the mold continues to rotate the material continuously coats the heated mold surface to form a homogenous layer of uniform thickness. The mold is then cooled by air or water and opened to allow the part to be removed.

An enclosed volume, such as a hollow ring or void, for example, forming a rim of a container, can be created during the molding process by forming a narrow opening(s) between the main compartment and the void in the mold. Plastic flows through the opening and coats the interior of the space forming the void. Layers of the material continue to form on the walls of the mold defining the void until the opening(s) is closed as a result of the thickness of the plastic layers exceeding the width of the opening(s). At this time the opening is bridged with material continuing to flow inside of the mold section forming the main compartment.

One method of forming a void, in a rotationally molded refuse container, to provide a rim for the container, is described in U.S. Pat. No. 5,922,267 ("'267 patent"). In the '267 container the void is vented directly to atmosphere during the molding process via vent tubes extending from the enclosed void through the mold wall. These vents enable air to be expelled from the void during the later stages of the molding process to ensure the development of a uniform nonporous coating of material within the void. Alternatively, the air within the void may be vented to the interior of the mold via widened openings or gaps which are not bridged over. The air exiting the void as well as air within the main compartment is vented to the atmosphere via a vent tube extending through the mold wall. Such a venting gap(s) must have a width sufficiently large to avoid being bridged over by the layered material during the molding process.

The '267 patent is directed to a relatively small refuse container designed primarily for residential use. Larger waste containers for industrial and commercial use, e.g., having a capacity of several or more cubic yards, have traditionally been made of metal, i.e, steel. These waste containers, sometimes referred to as dumpsters, include side pockets or channels sized to receive the prongs or blades of a lifting mechanism, traditionally carried by waste transport trucks, which lift and empty the dumpster's contents into the truck's storage area for transport to a dump site. Such dumpsters conventionally have closure lids pivotally mounted to the back rim of the dumpster and many are equipped with a manual locking mechanism located at the front of the dumpster to prevent access to the dumpster's interior during certain times such as nights or weekends. In addition, casters are generally mounted to the bottoms of the dumpsters to facilitate their movement from a storage area to a location accessible by a waste transport truck. Such steel containers are not only heavy, but are subject to rusting, requiring considerable maintenance.

A prior art rotationally-molded plastic waste container, designed for industrial/commercial use, capable of holding several cubic yards of refuse is presently on the market. While the container is lighter and substantially maintenance free as compared to conventional steel dumpsters, it utilizes steel pockets for receiving the lifting mechanism prongs. The steel pockets which are bolted to the container side walls support the container and its contents on the lifting prongs. In addition, the lid is pivotally mounted to the back rim of the container by means of a steel bracket. The steel components are not only expensive as compared to the plastic material used to form the storage compartment, but must be manually attached to the plastic container during an assembly process and are subject to rusting. In addition, considerable noise is generated when the lifting prongs engage the steel pockets. In an effort to reduce this noise plastic sleeves have been inserted into the steel pockets increasing the costs. A brochure illustrating this prior art container, marketed by Nuwave Container, Inc., is attached to the Information Disclosure Statement ("IDS"). In addition, excerpts from the web sites of Cascade Engineering and Pacific Compactor Corp. Showing injection and rotationally molded trash containers in which steel pockets for receiving the lifting prongs are bolted to the container compartment are attached to the IDS.

There is a need for a molded plastic waste container which overcomes the above disadvantages.

SUMMARY OF THE INVENTION

In accordance with the present invention a molded plastic container, suitable for receiving waste material and capable of accommodating the prongs of a lifting mechanism, includes a hollow material carrying compartment having a bottom, rear, front and opposed side walls. A plastic pocket defining a prong receiving channel, located on each side wall, is integrally formed with the compartment, i.e., molded therewith or pre-molded and subsequently bonded thereto. The pocket may comprise a generally rectangularly shaped tube section located adjacent the front and rear walls of the container or include a rectangularly-shaped central section extending between the end sections to form an elongated prong receiving channel. Optionally, the channels may include a generally rectangular metal tube integrally molded therein or added after the molding operation. Preferably the front, back and side walls terminate in an integrally molded, generally hollow rim which defines the opening through which materials may be deposited in and removed from the container.

The container may further (and preferably does) include an appendage or skirt extending around each pocket, the skirt being formed by one or more c-shaped sections extending outwardly from the compartment. The skirt may, and preferably does, include aligned upper and lower generally u-shaped struts, open to the compartment interior, but closed to the exterior, extending along the side walls above the pockets (preferably to the rim) and below the pockets, respectively. In addition, the container may be provided with a spaced lid accommodating hinge ears on the rear rim/wall integrally molded with the container. The hinge ears define an elongated bore there through for receiving a hinge pin adapted to pivotally secure a lid(s), to the rear rim of the container. Further, a plurality of caster receiving plates may be mounted to the container bottom with one or more casters secured to each caster plate. In addition, a locking rod may be slidably secured within the hollow rim at the front of the compartment for releasably coupling with downwardly extending locking pins or bolts carried by a lid.

With respect to the method, a mold is provided having an interior space defining the container compartment section and an appendage or skirt forming portion extending outwardly from each side of the compartment section. The pockets, defining the prong receiving channel, are formed by generally rectangular removable (or non removable) cores inserted into the skirt portions during the biaxial rotation of the mold or by a separate sleeve later inserted into the molded skirts.

With respect to the former method, the mold is arranged to include one or more gaps between the removable core and the junction of the skirts and the compartment section with the gaps being dimensioned to be bridged over during the molding process. The core or cores have an inner side aligned with the compartment forming wall. The skirt portions of the mold include an outer c-shaped shell generally rectangular and joined to the compartment forming wall above and below the respective cores and spaced from the three other sides of the core to accommodate the flow of material there between during the molding process. A sufficient amount of powdered or molten plastic (e.g., thermoplastic) material is placed in the mold to provide the desired thickness of the finished container. The mold is then heated and biaxially rotated to allow the plastic material to flow over and progressively adhere, in successive layers, to the heated mold surface to form the compartment while simultaneously the material is allowed to flow through the gaps to form the pockets until the material bridges over the gaps. Any partially enclosed spaces between the pockets and the skirt forming portions of the mold are vented to the atmosphere, preferably via the compartment interior which in turn is vented directly to the atmosphere. Preferably, the skirt forming portions of the mold are arranged to form struts extending upwardly and downwardly from the enclosed pockets.

In an alternative method of forming the pockets, a molded rectangular sleeve is subsequently inserted into each finished skirt with each sleeve forming a portion of the respective compartment side wall and being welded thereto. The pockets in conjunction with the skirts (if used) are the structural components which support the container and its load on the lifting prongs.

Preferably the mold includes structure to accommodate the simultaneously molding of a hollow rim, hinge ears on the back rim portion and u-shaped struts extending above and below the channels.

The features of the container and the method of fabrication can best be understood by reference to the following description taken in conjunction with the appended drawings where like components are given the same reference numerals.

BRIEF DESCRIPTION OF THE DRAWINGS

FIGS. 21, 22 and 23 are perspective views of an alternative embodiment of the container with FIGS. 21 and 22 showing one-half of a pivotally mounted lid in the closed and partially open position, respectively, while FIG. 23 shows casters attached to the bottom wall;

DESCRIPTION OF THE PREFERRED EMBODIMENT

Figure 1:
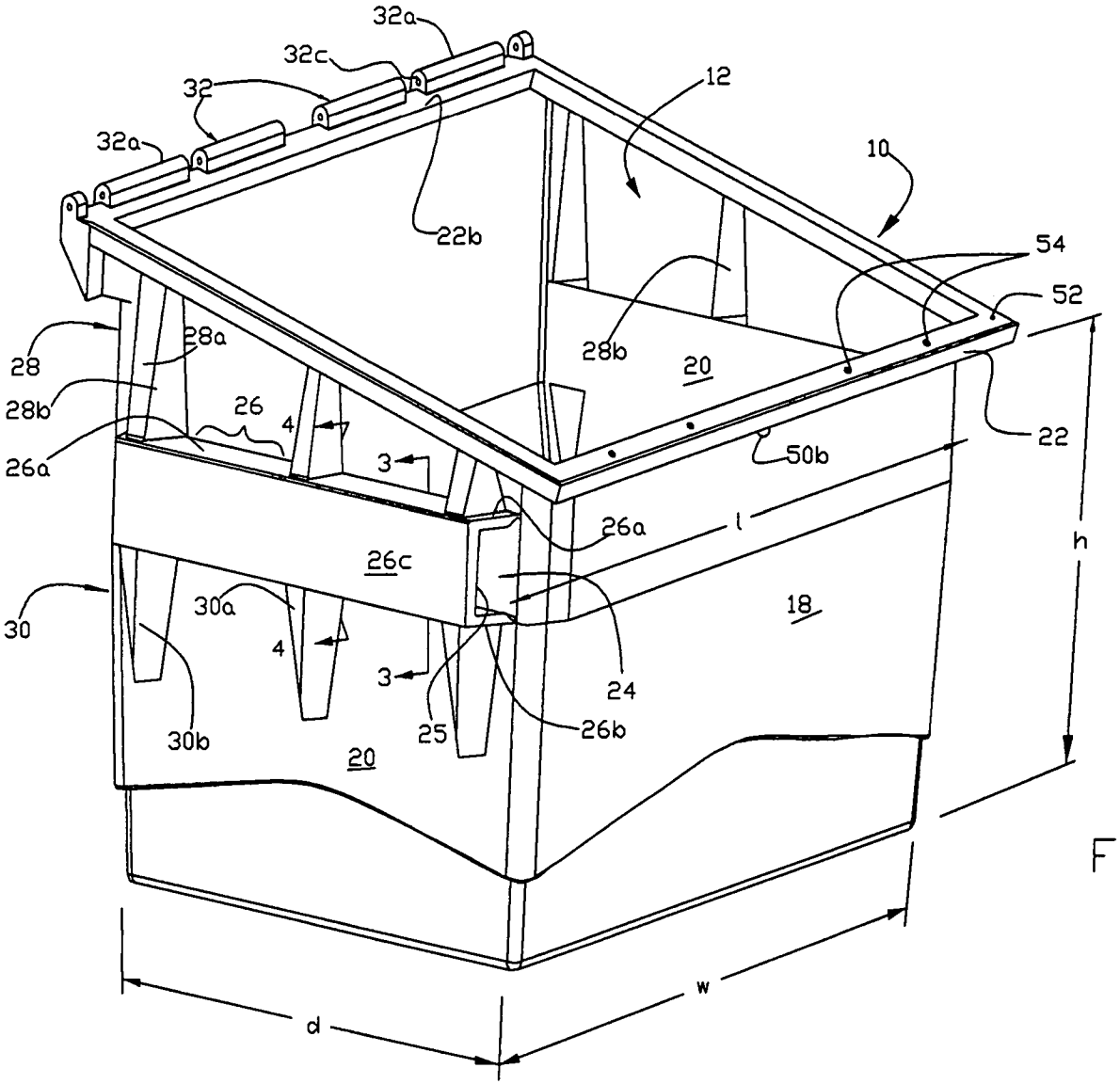
FIGS. 1 and 2 are different perspective views of an integrally molded container in accordance with the present invention, with FIG. 2 showing casters attached to the bottom wall.
Figure 2:
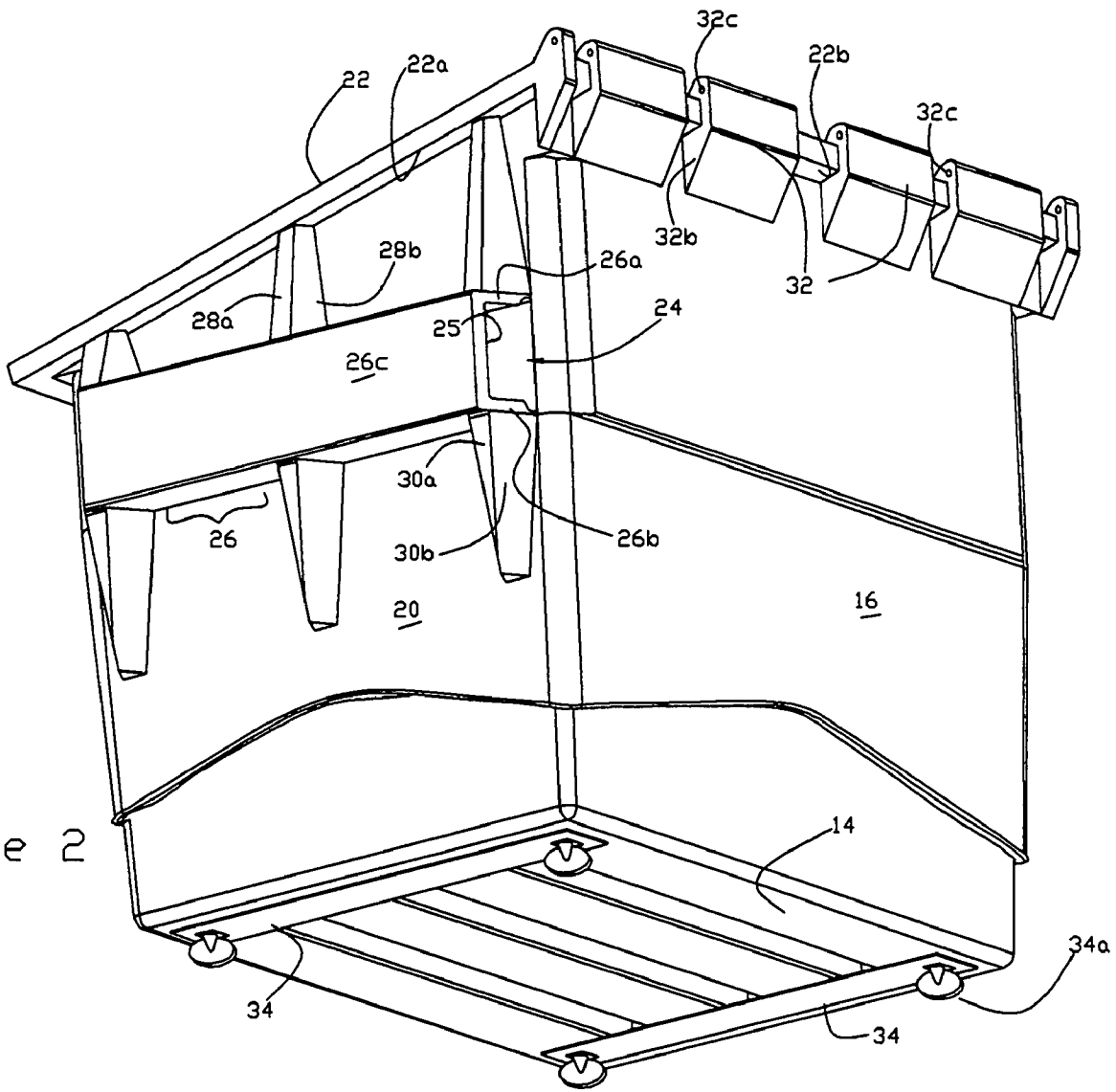

Referring now to the drawings and in particular to FIGS. 1 and 2, the container 10 of the present invention includes a material carrying compartment 12 having a bottom, rear, front and opposed side walls 14, 16, 18 and 20, respectively. The front, back and side walls terminate in a hollow rim 22. A pair of generally rectangularly shaped channels 24, located on each side wall and formed in integrally molded pockets 25, are adapted to receive the prongs (not shown) of a waste material transport truck, for example. The pockets 25 are formed with an inner wall 25*a* which forms a portion of the compartment side walls 20. The pockets also include top, bottom and outer walls 25*b, c,* and *d,* respectively. See FIGS. 3 and 4. An appendage or skirt in the form of c-shaped sections 26 (rectangular in cross-section with an open side joined to the compartment side wall) separated by strut sections with upper and lower generally u-shaped struts 28 and 30, respectfully, extend around each of the pockets 25. As is shown in FIGS. 1 and 2, the c-sections are formed at the front and rear of the pockets as well as at intermediate locations and are joined to the compartment side walls above and below the channels as shown. The c-shaped sections 26 and the strut sections share a common vertical exterior side wall 26*c*. The upper struts extend upwardly along the side walls 20 to the bottom 22*a* of the rim 22. The lower struts 30 extend downwardly along the sidewalls 20 of the container as shown. The struts include, in addition to the shared wall 26*c,* a cap 28*a,* 30*a* connected to the sides 20 of the container compartment via ribs 28*b,* 30*b*. The struts are open to the interior of the container and the rim, as is illustrated in FIGS. 1 and 4.

Figure 4:
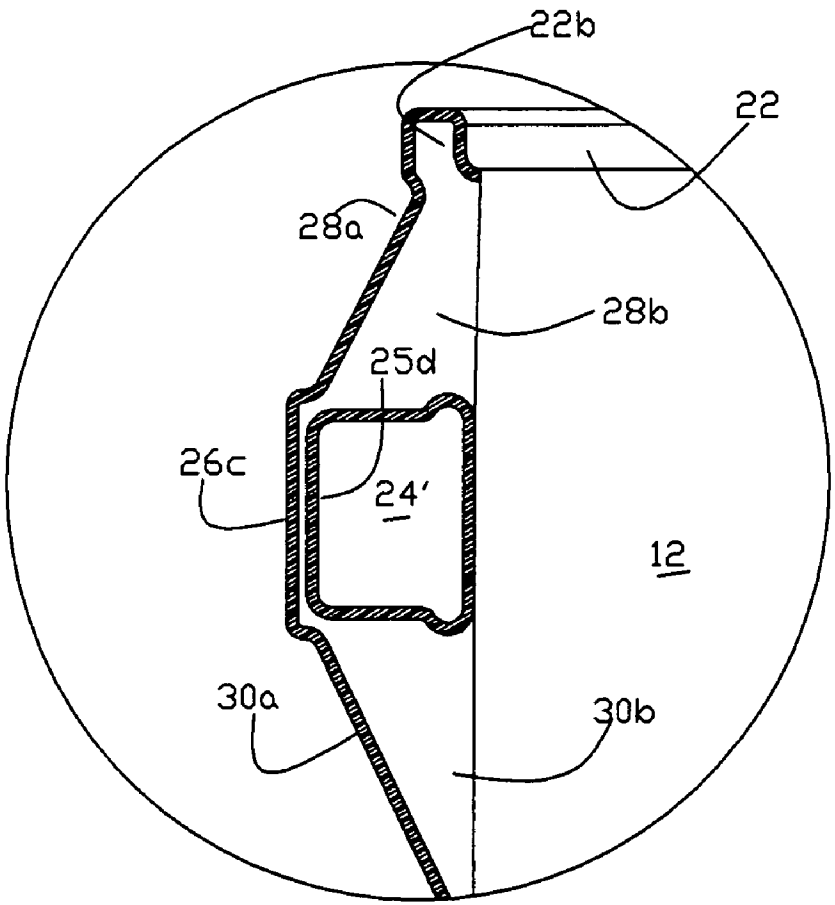
FIG. 4 is a broken away cross-sectional view of the pocket and a surrounding skirt section forming upper and lower struts taken along lines 4-4 of FIG. 1.
Figure 3:
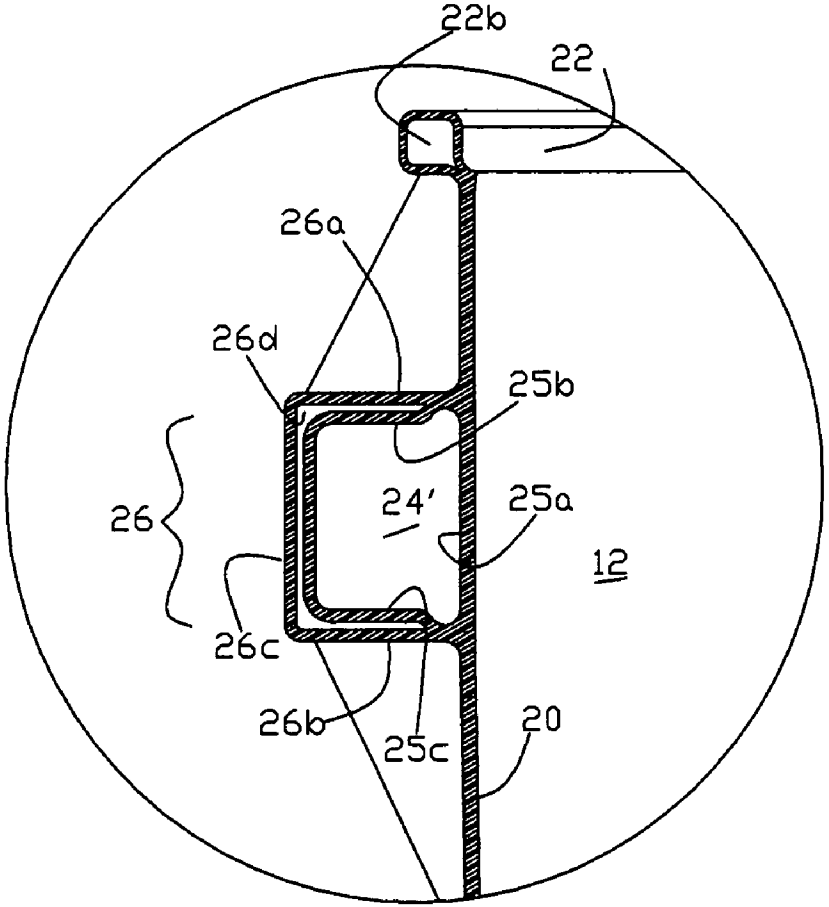
FIG. 3 is a broken away cross-sectional view of the pocket forming the channel and a surrounding c-shaped skirt section taken along lines 3-3 of FIG. 1.

FIG. 3 is a broken away cross sectional view taken of one of the skirt c-sections 26 extending around a pocket 25 and FIG. 4 is a view taken through one of the skirt strut sections also extending around the pocket. The struts provide additional strength for the pockets and vent air from enclosed spaces 26*d* (FIG. 3) between the pockets and the surrounding skirt sections (between the struts) during fabrication, as will be explained. The struts also vent air from the interior 22*b* of the rim (FIG. 4).

It is to be noted that in the provisional application the appendages and the pockets were treated as one component while they are treated as separated items herein.

Figure 6:
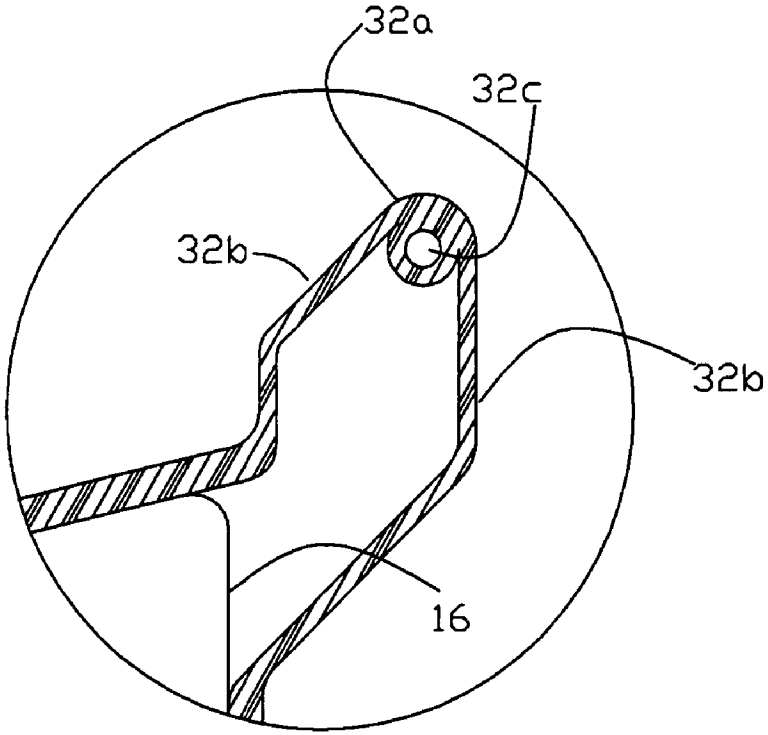
FIGS. 5 and 6 are broken away cross-sectional views at the back rim of the container showing the hollow rim and hinge ear, respectively.
Figure 5:
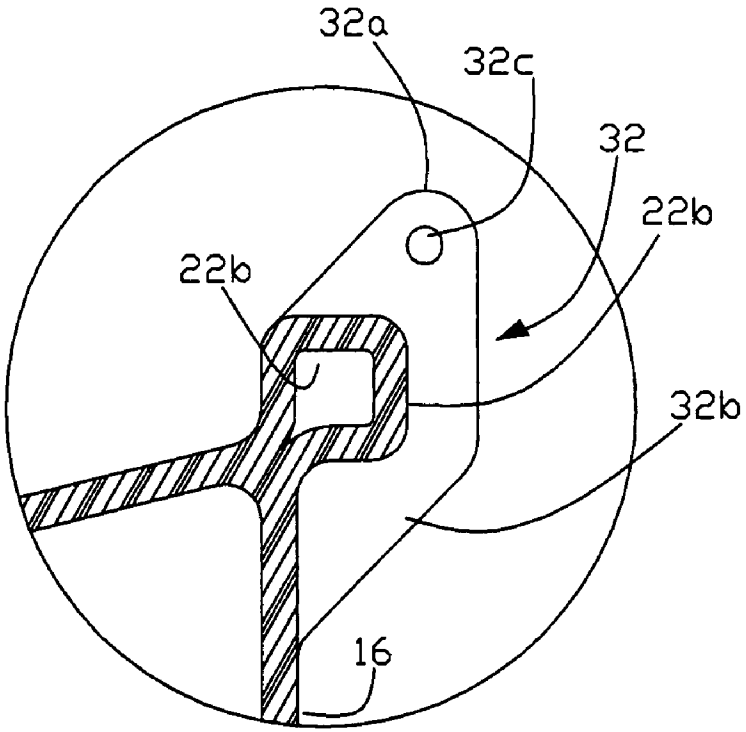

Referring again to FIGS. 1 and 2, spaced hinge ears 32 are integrally formed on the rear wall and rim of the container. These ears are in the form of a cap 32*a* connected to the back rim portion 22*b* and the back container wall 16 via ribs 32*b*. The ears define aligned lateral bores 32*c* adapted to receive an elongated hinge pin or rod (not shown) for pivotally attaching a lid or lids (63, FIG. 21) to the container's back rim/wall. The hinge ears are closed to the exterior, but open to the interior of the rim and the container compartment and also serve to vent air from the interior of the rim 22*b* to the compartment interior during the molding process. FIGS. 5 and 6 are cross sectional views taken along the back rim portion 22*a* showing the hollow rim cross section (FIG. 5) and the hinge ear cross section (FIG. 6).

The containers may be made with different volumetric capacities, i.e., 2-7 or more cubic yards. The center line distance l between the channels 24 will typically be 72" to accommodate the spacing between standard lifting prongs.

The pockets may generally define an 8" high by 4" wide opening. The following are examples of the approximate height (h), width (w), and depth (d) (FIG. 1) of waste containers for the volumetric capacities noted:

| Capacity | Width (w) | Height (h) | Depth (d) |
|---|---|---|---|
| 2 yards | 68" | 39" | 30" |
| 3 yards | 63" | 44" | 36" |
| 4 yards | 67" | 47" | 44" |

A pair of caster plates 34 (preferably also rotationally molded), carrying casters 34*a,* are secured to the bottom of the container compartment via plastic spin fittings fused to the bottom wall 14 as will be described in more detail in conjunction with FIG. 18.

Figure 7:
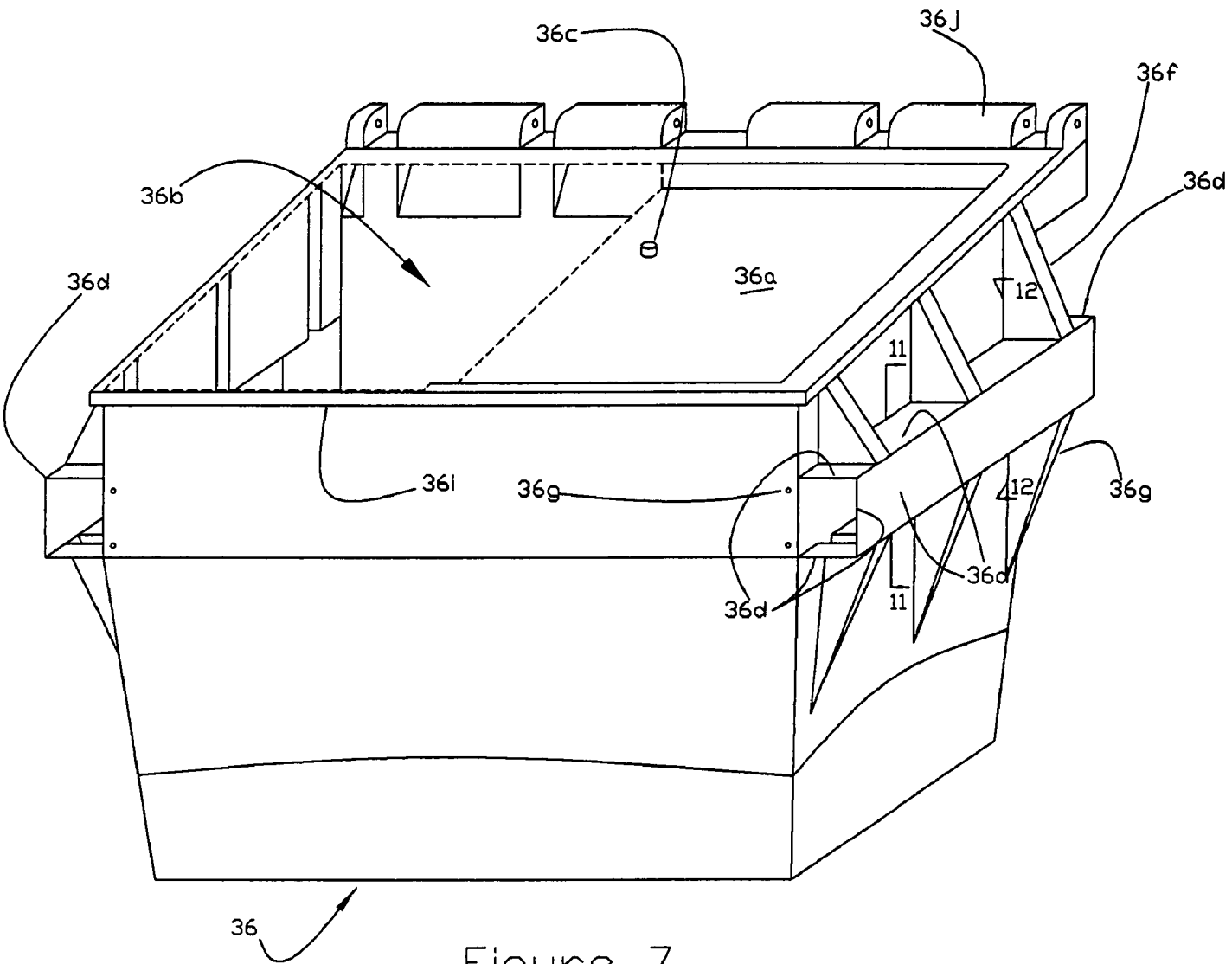
FIG. 7 is a front perspective view of a mold for the container of FIGS. 1 and 2 with the top cover partially removed to show a portion of the interior of the mold.

A mold 36, preferably made of aluminum or other suitable material, the interior of which mirrors the exterior of the finished waste container, is illustrated in FIG. 7. It is to be noted that the several parts of the mold, which are conventionally clamped together, are not shown separately in FIG. 7 for clarity. One half of the top plate 36*a* of the mold has been removed for clarity. A central portion of the top plate 36*a* is insulated to prevent the plastic material from bonding thereto since the finished container has an open top as explained previously. The plastic which forms under the edges of the top plate is cut away after the container is cooled as will be apparent to those skilled in the art.

A compartment section 36*b* includes bottom, rear, front and opposed side walls (not separately identified) in which the open topped material carrying compartment 12 is formed. A vent pipe 36*c,* extending through the top plate 36*a* serves to vent the compartment section of the mold to atmosphere.

Figure 12:
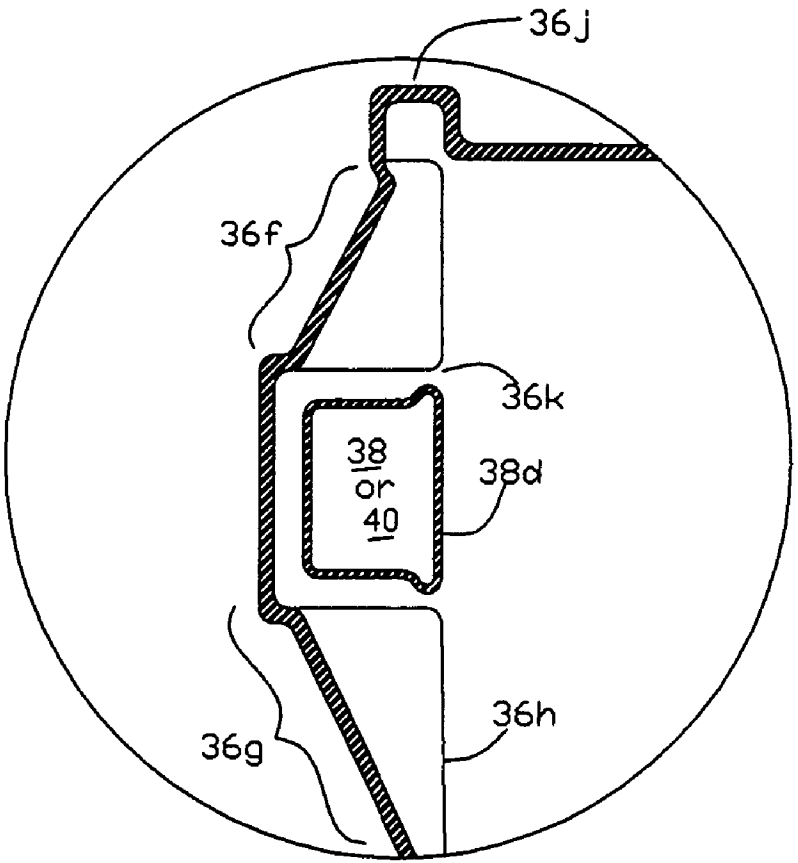
FIGS. 11 and 12 are broken away cross-sectional views of the mold taken along lines 11-11 and 12-12 of FIG. 7, respectively, showing the mold portions which form the skirt/c-sections and pocket/skirt strut sections of the container.

The mold further includes a skirt c-shaped section forming portions 36*d,* separated by upper and lower strut skirt forming portions 36*f* and 36*g,* respectively. See FIGS. 7, 11 and 12. The skirt forming portion of the mold, in conjunction with a removable (38) or non removable (40) core (FIGS. 8 and 10), forms the rectangular pockets and skirts in the finished container.

Figures 8, 9, 10:
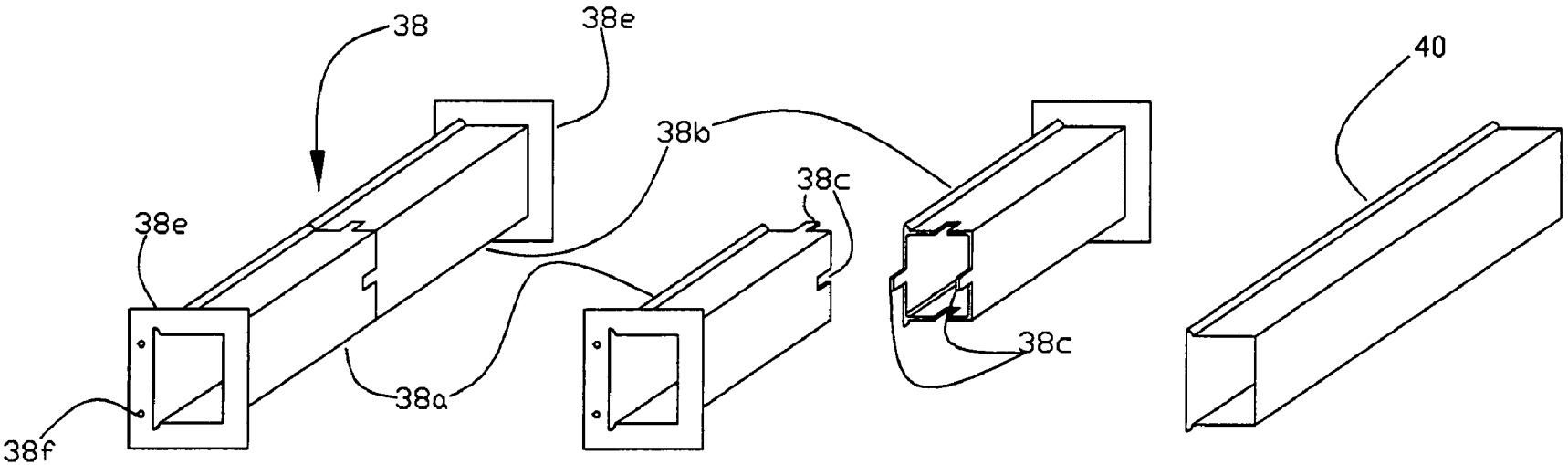
FIG. 8 is a perspective view of an assembled removable core element for insertion into the skirt forming portion of the mold.
FIG. 9 is an unassembled perspective view of the core element of FIG. 4.
FIG. 10 is a perspective view of a nonremovable core adapted to be integrally molded into the pocket.
Figure 11:
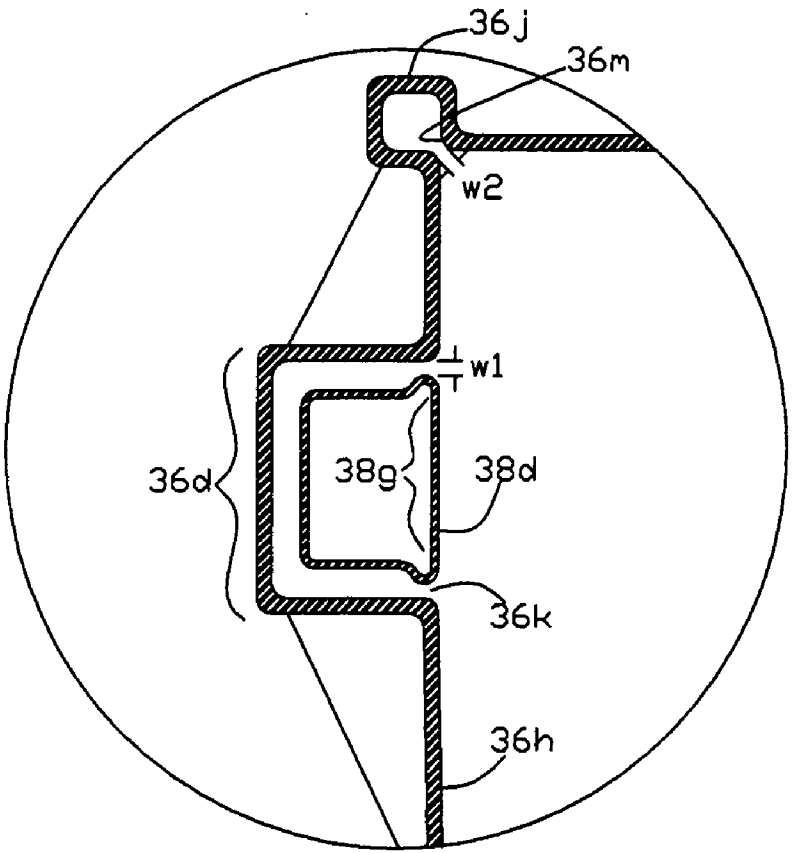

Referring now to FIGS. 8 and 9 the removable core 38 is formed in two pieces, 38*a* and 38*b,* with indexing tongues and grooves 38*c* on the distal ends thereof to align the assembled pieces so that the outside surface 38*d* of the inner wall of the core coincides with the plane of the inner mold wall 36*h* (FIG. 11) when flanges 38*e* are bolted to the mold wall via holes 38*f* and threaded blind bores 36*g* in the mold wall as is illustrated in FIGS. 7 and 8.

As an alternative, a nonremovable core 40 (FIG. 10), which may also be of an appropriate metal, such as steel, may be positioned within the skirt forming mold portion via flanges similar to 38*e,* but with inwardly projecting stubs (not shown) which releasably slide into the ends of the sleeve to align the sleeve so that the outer surface of the inner side 38*d* coincides with the plane of the inner mold wall 36*h*.

The mold 36 further includes rim section 36*i* and hinge ear sections 36*j* as is illustrated in FIG. 7 for forming the hollow rim and hinge ears, respectively.

The cores 38 are formed with a slightly extended inner side 38*g* to form gaps 36*k* of width w1 between the cores and the compartment forming wall 36*h*. See FIG. 11. These gaps allow the powdered material to flow into the space between the core and the inner surface of the skirt c-section forming portions of the mold. The material adheres to the outer surface of the core as well as the inner surface of the skirt forming portions of the mold during the molding process. The width w1 of the gap between the compartment section and core 38 must be compatible with the plastic material used and the desired finished thickness of the container so that the material will bridge over the gaps in the later stages of the molding process. The width w1 should be within the range of 3/16" to ½" to provide a nominal wall thickness of around ¼". For example, a width w1 of about 5/16" has been found satisfactory to provide about a ¼" container wall thickness with a 35 mesh polyethylene material.

The gap 36*m* (FIG. 11) between the compartment wall and the rim section has a width w2 which also is dependent upon the above parameters to ensure that the gap will be bridged over.

Figure 14:
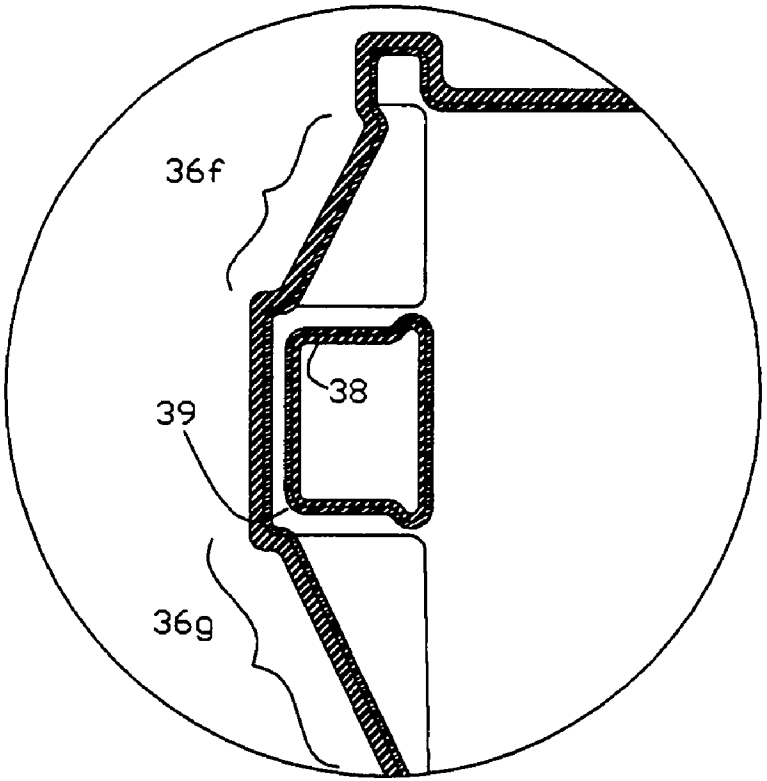
FIGS. 13 and 14 are broken away cross-sectional views of the mold portions of FIGS. 11 and 12, respectively, with plastic layers formed thereon during an early part of the molding process.
Figure 13:
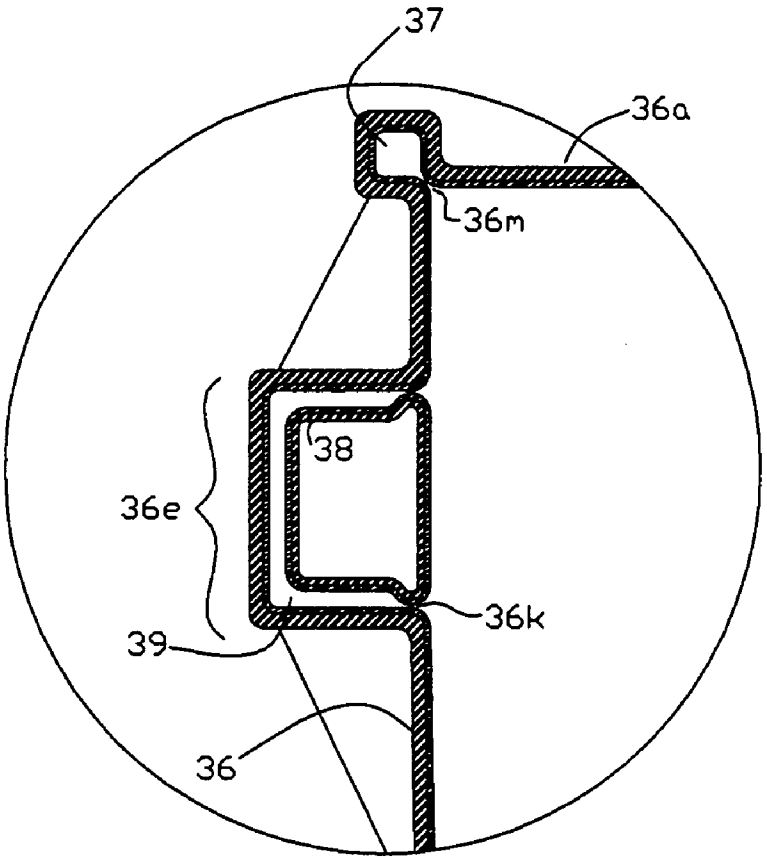

To fabricate the container, a sufficient amount of the selected plastic material (powdered or molten) is placed in the compartment section of an assembled mold and the mold is heated and biaxially rotated and, as an example only, within a ratio range of about 1:1 to 6:1 between the two perpendicular axes of rotation and at about 8-10 rpm. The powder flows over and bonds to the mold interior in successive layers. At the same time the material flows through the gaps 36*k* forming a layer over the outside of the core 38 and the inner wall of the skirt c-section forming a portion of the mold as is illustrated in FIG. 13. The material also flows through gaps 36*m* to form the hollow rim. At the same time the material flows over and bonds to the inner surface of the skirt strut forming portions 36*f* and 36*g* as is illustrated in FIG. 14. It is to be noted that the spaces 26*d* between the two plastic walls being formed inside of the skirt c-section forming portions of the mold are vented to the interior of the compartment mold section via the struts which remain open to the compartment section 36*b* as is shown in FIGS. 13 and 14. The space within the rim section is also vented to the mold compartment section via the struts and the ear hinges which are also open to the mold interior.

Figure 16:
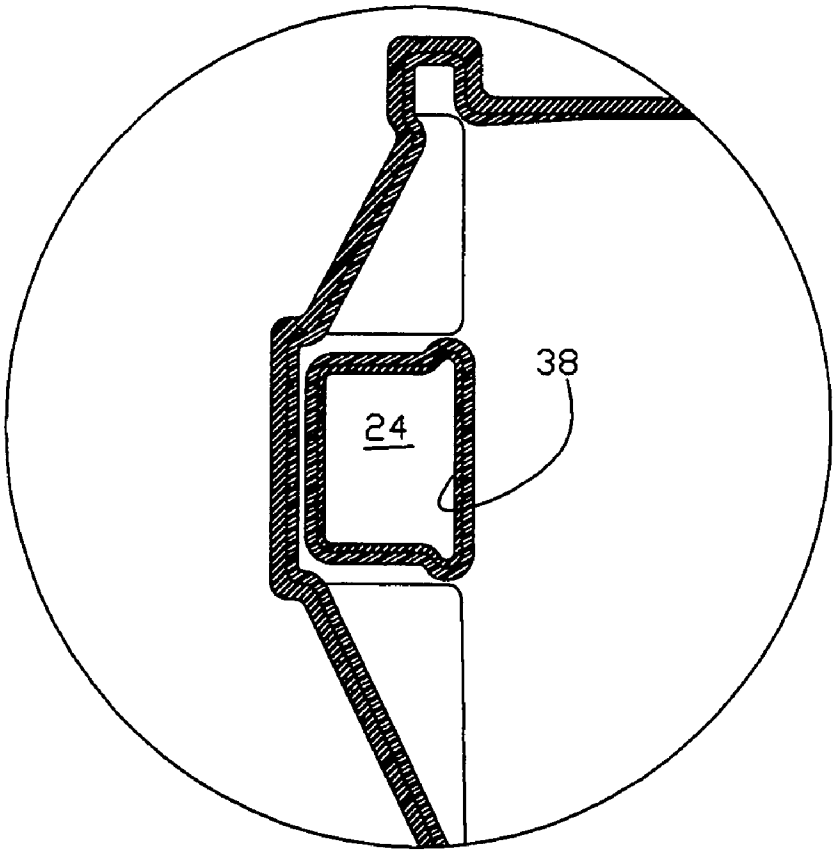
FIGS. 15 and 16 are broken away cross-sectional views of the mold portions of FIGS. 11 and 12 with a finished layer of plastic thereon, respectively.
Figure 15:
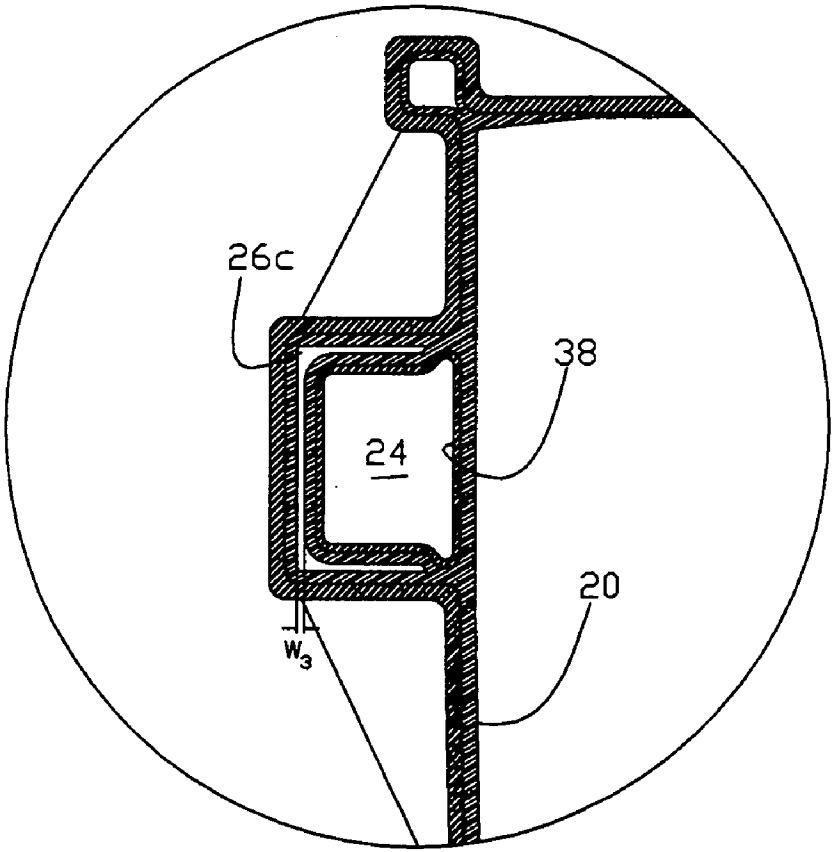

FIGS. 15 and 16 illustrate the finished rectangular pocket, skirt c-section and skirt strut section of the container (within the mold) with the gaps 36*k* and 36*m* bridged over. The distance w3 between the two plastic walls between the pocket and the skirt c-section, as shown in FIG. 15, must be sufficient to prevent the layers forming the walls from bridging over during the molding process. As an example only, it has been found that a distance w1 of about ½" is satisfactory for a ¼" nominal wall thickness. It should be noted that the wall 20 of the container extending above and below the pocket forming channel 24, is not shown in FIG. 16 for clarity. The pocket forming the channel 24, in the finished container, may be formed entirely of plastic, with the core 38 removed, or include an inner sleeve 40.

Figure 18:
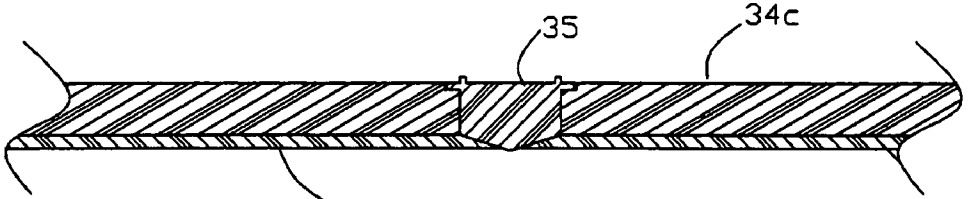
FIG. 18 is a broken away cross-sectional view showing the manner in which the plate of FIG. 17 is secured to the container bottom.
Figure 17:
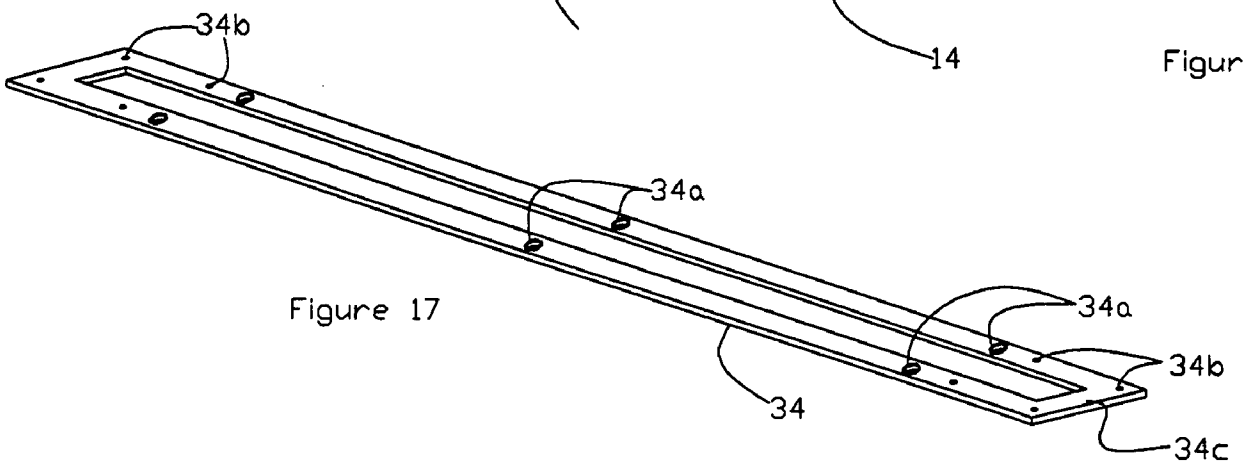
FIG. 17 is a perspective view of a plastic plate 34 (FIG. 1) which serves to secure casters to the bottom of the container.

Referring now to FIG. 17 the caster plate 34, preferably also rotationally molded, includes spaced openings 34*a* in which plastic spin fittings 35 may be inserted and spun at high speed to fuse the fitting to the plate and the container bottom wall 14 as is illustrated in FIG. 18.

Threaded t-nuts (not shown), for receiving the casters, may be inserted through two or more of the holes 34*b* from the top 34*c* of the caster plate to the be captured within the plate when it is secured to the container bottom.

Figure 19:
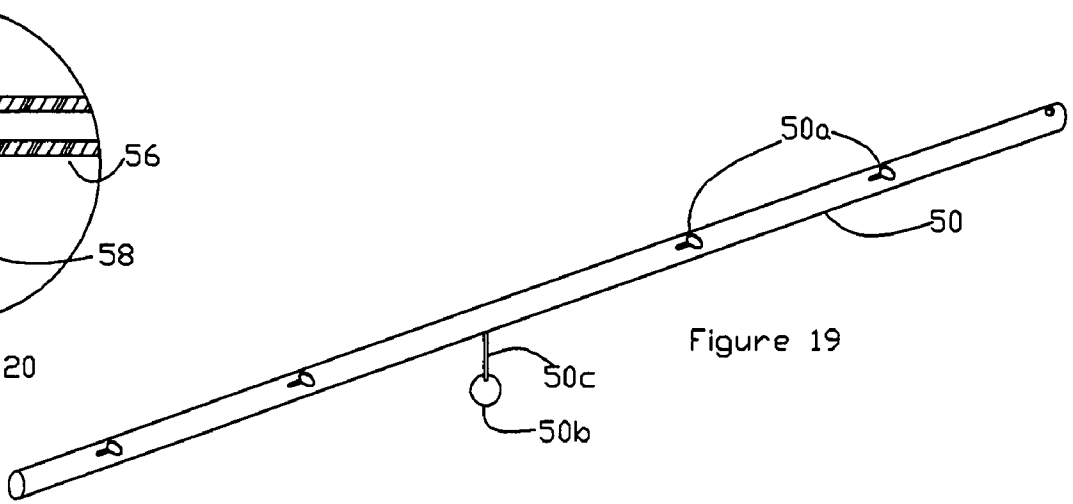
FIG. 19 is a perspective view of a locking rod located in the front rim for releasably locking a lid to the container.
Figure 20:
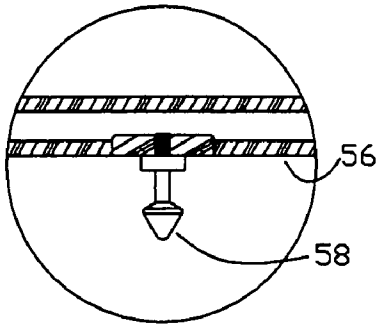
FIG. 20 is a cross-sectional view of a portion of the front rim of a container lid showing a locking pin mounted therein.

The locking rod 50, shown in FIG. 19, is preferably slidably mounted within the front container rim. The rod 50 is provided with four key hole shaped openings 50*a* and an actuating knob 50*b* attached to the lower end of the rod via a shaft 50*c*. The shaft, which slides in a slot (not shown) formed in the bottom of the front rim, serves to maintain the openings 50 aligned with headed pins mounted in the front rim of the lid. FIG. 20 shows one such locking pin 58 mounted to the front rim of a lid 56. Holes 54 in the top of the container front rim 20 (FIG. 1) receive the heads of the locking pin 58. To lock the lid to the container the rod is moved sideways, via knob 50, until the keyholes capture the heads of the pins 58 in a conventional manner. A padlock shackle may then be inserted through hole 52 of the front rim and the hole 50*d* to hold the rod in place and maintain the lid(s) in a locked configuration.

A modification of the container and mold therefor are illustrated in FIGS. 21-36 wherein features corresponding to those shown in the earlier figures are designated with a prime number.

Figure 21:
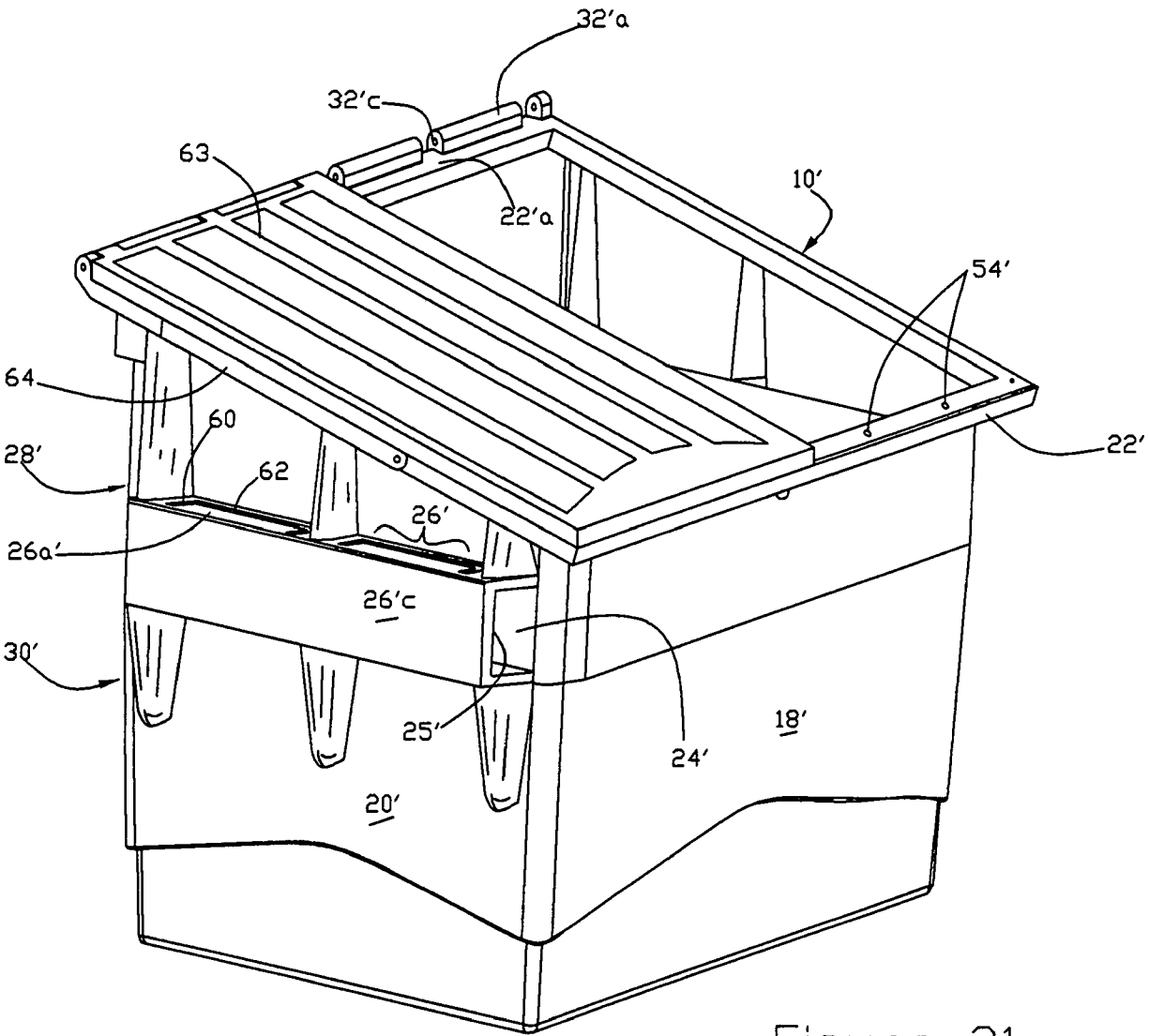
Figure 22:
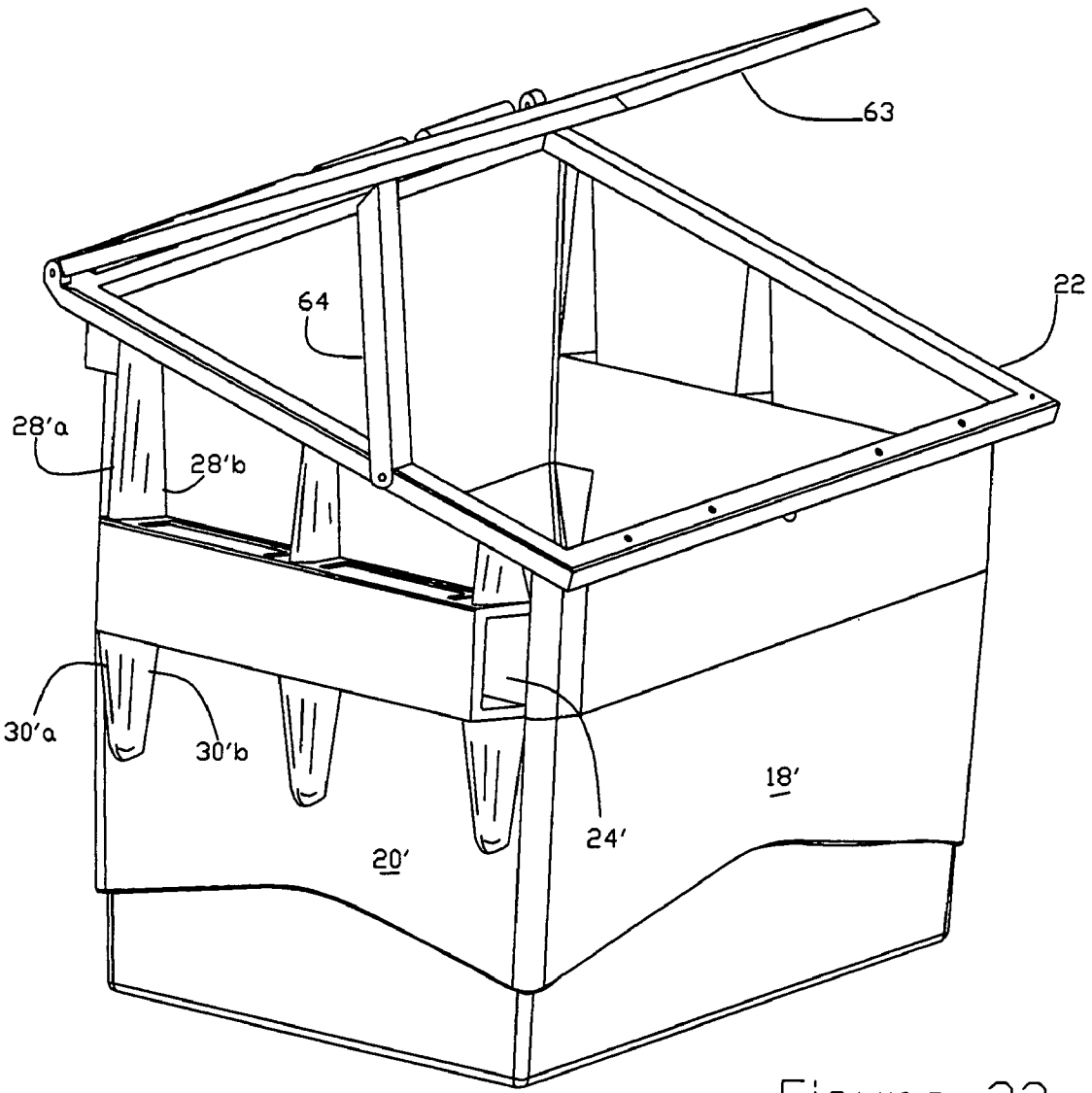
Figure 23:
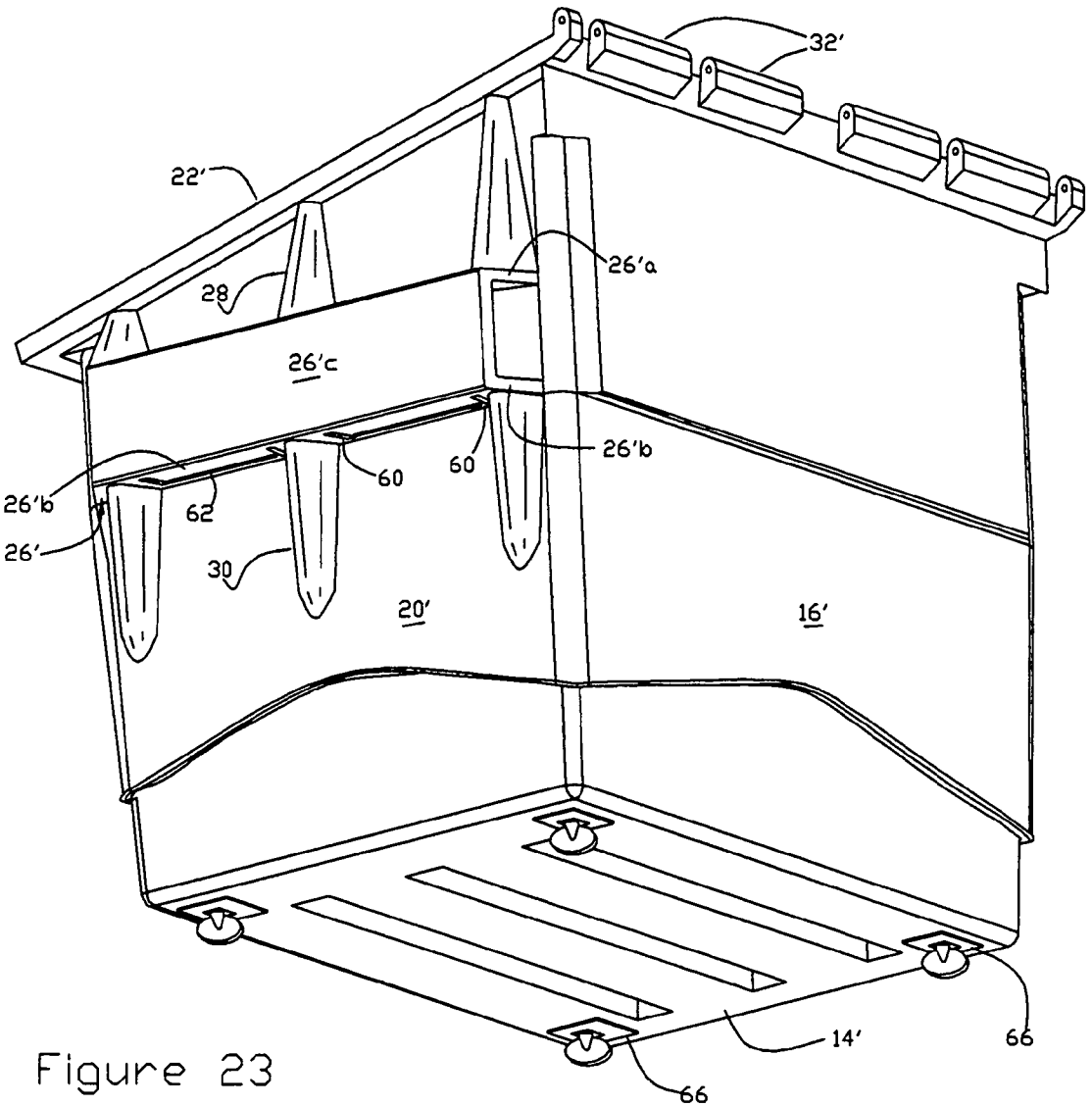
Figure 24:
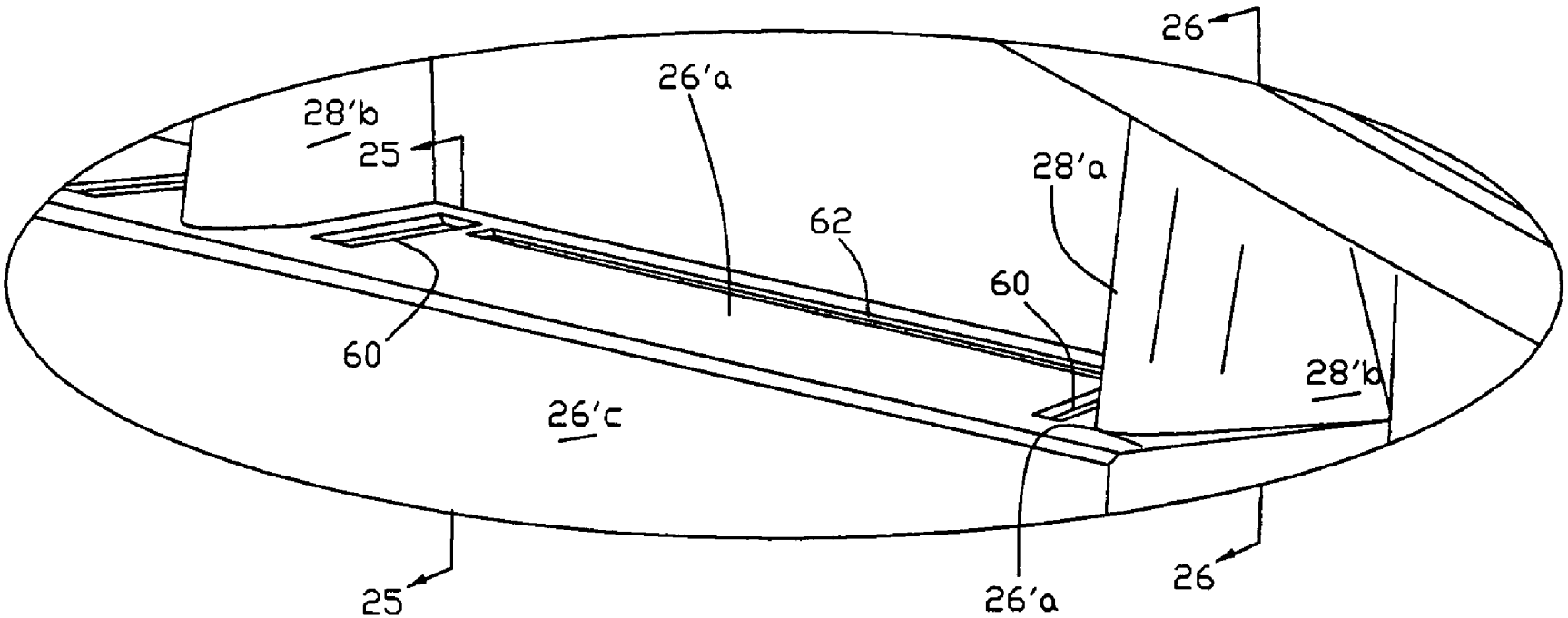
FIG. 24 is an enlarged broken away view of a portion of one of the skirt c-sections of the alternative embodiment showing elongated depressed portions extending between and along the sides of the struts for adding strength to the pockets.
Figure 26:
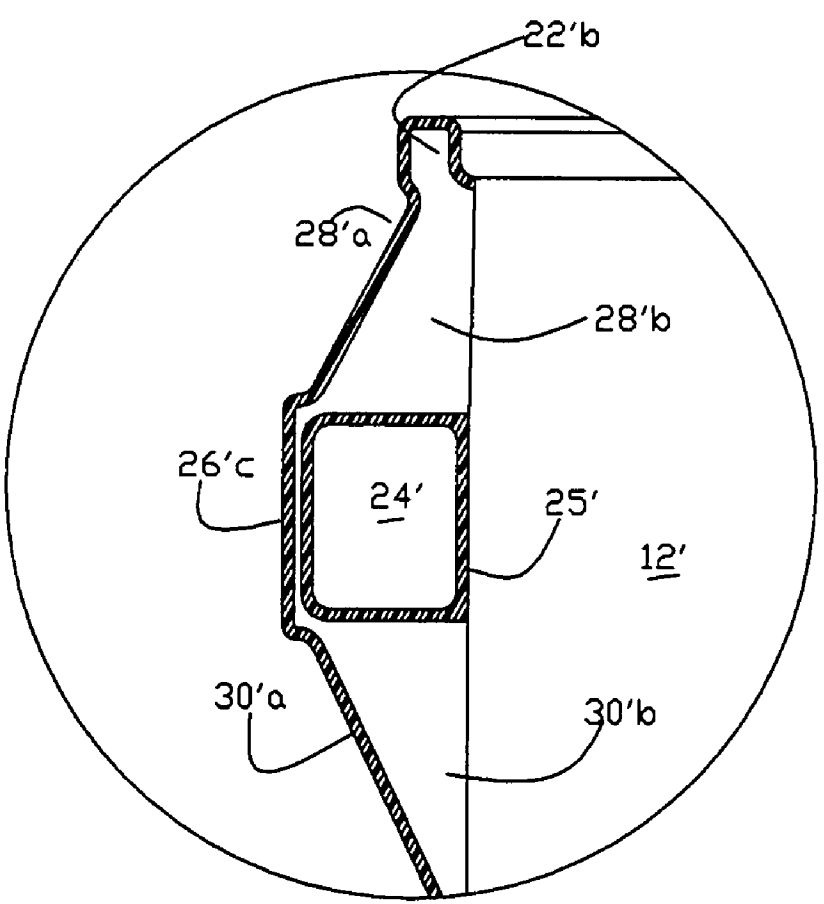
FIG. 26 is a broken away cross-sectional view of the skirt strut section and adjoining compartment side walls taken along lines 26-26 of FIG. 24.
Figure 25:
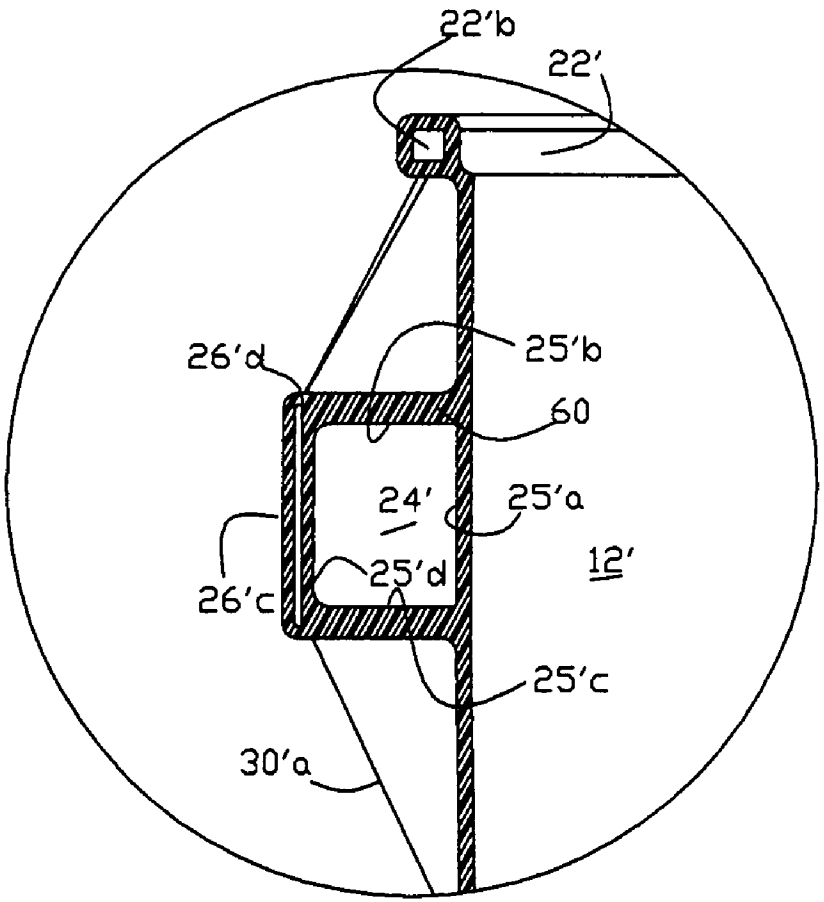
FIG. 25 is a broken away cross-sectional view of the skirt c-section through a depressed portion (60) adjacent a strut taken along lines 25-25 of FIG. 24.

As is illustrated in FIGS. 21-23, the modified container is formed with upper and lower struts with rounded caps 28'*a* and 30'*a* and with the channels 24' being rectangular in cross-section, eliminating the inset grooves adjacent the container compartment wall formed by the extended inner side 38*g* of the core 38. Depressions 60 and 62 are formed in the top 26'*a* and bottom 26'*b* walls of the skirt c-sections adjacent the struts and the compartment side walls 20' of the container as shown. See FIG. 24 which illustrates the depressions on the top wall 26'*a* of the skirt. These depressed areas (formed by the mold) allow the plastic material to bridge over the gap between the walls formed between the skirts and pockets during the molding process at these locations, as will be explained in more detail. These bridged over areas (60 and 62) increase the strength of the skirt/pocket appendage defining the prong receiving channel. Cross-sectional views, FIGS. 25-26, are similar to FIGS. 3 and 4 with FIG. 25 illustrating that the space under the depressed areas 60 is bridged over.

Figure 28:
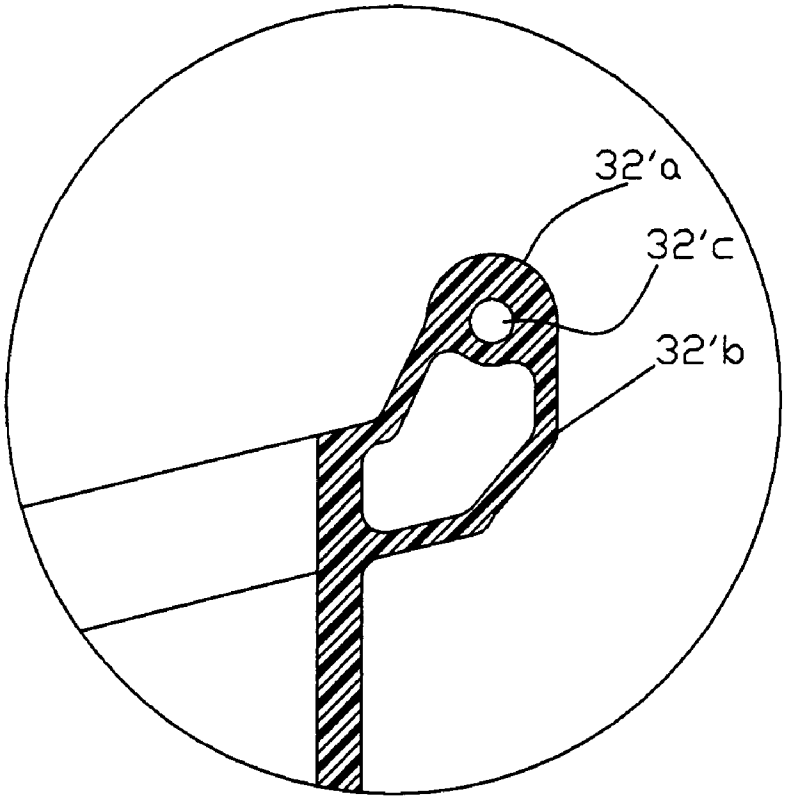
FIGS. 27 and 28 are broken away cross-sectional views of the back rim of the container of FIG. 26 showing the hollow rim and hinge ear respectively.
Figure 27:
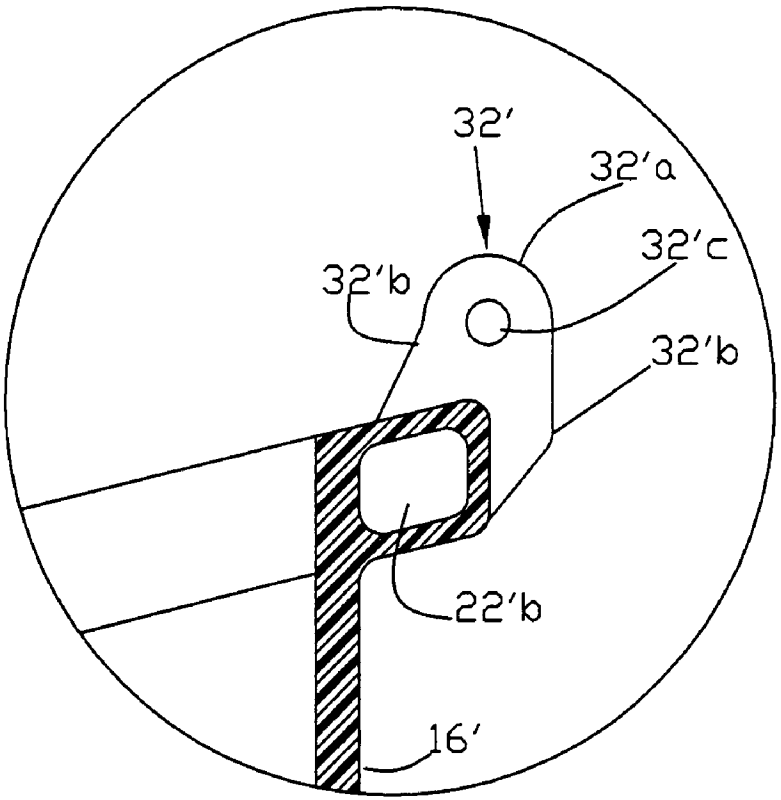

The hinge ears 32' are similar to the ears 32 in FIGS. 5 and 6, but are molded integrally only with the back rim portion 22*a* as is illustrated in FIGS. 27 and 28.

Referring again to FIGS. 21 and 22, a split lid 63 (one half of which is shown) is pivotally mounted to the hinge ears. See FIG. 37. A lever arm 64 is pivotally mounted at one end to the rim and arranged to engage the periphery of the lid to hold the lid in a raised position as is illustrated in FIG. 22. The lid can be raised slightly from its raised position (FIG. 22) to allow the arm to fall into its stowed position as illustrated in FIG. 21.

Figure 38:
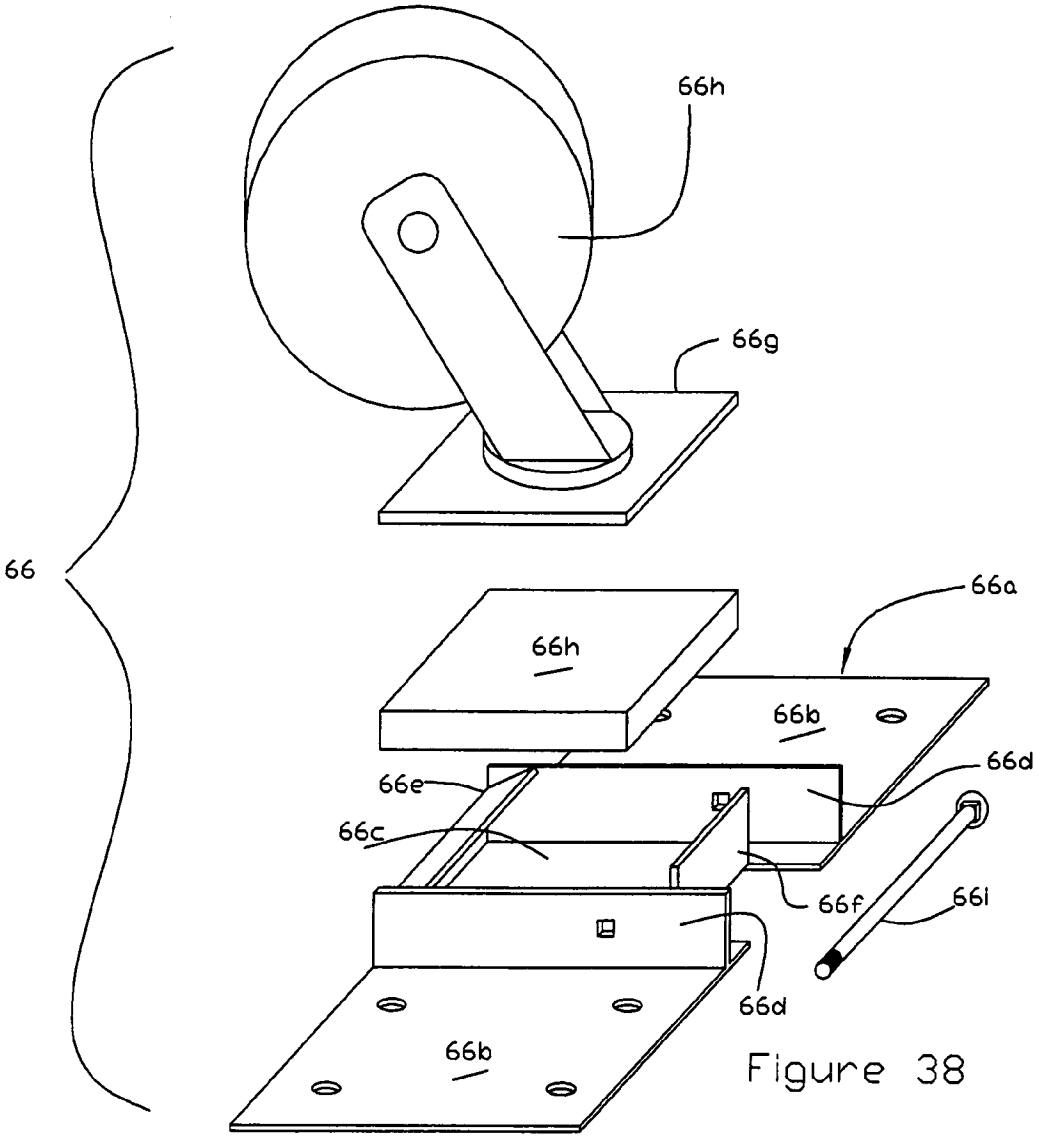
FIG. 38 is an enlarged perspective view of one of the caster plate assemblies.

Caster assemblies 66, to be described with respect to FIG. 38 are mounted on the bottom wall of the container.

Figure 29:
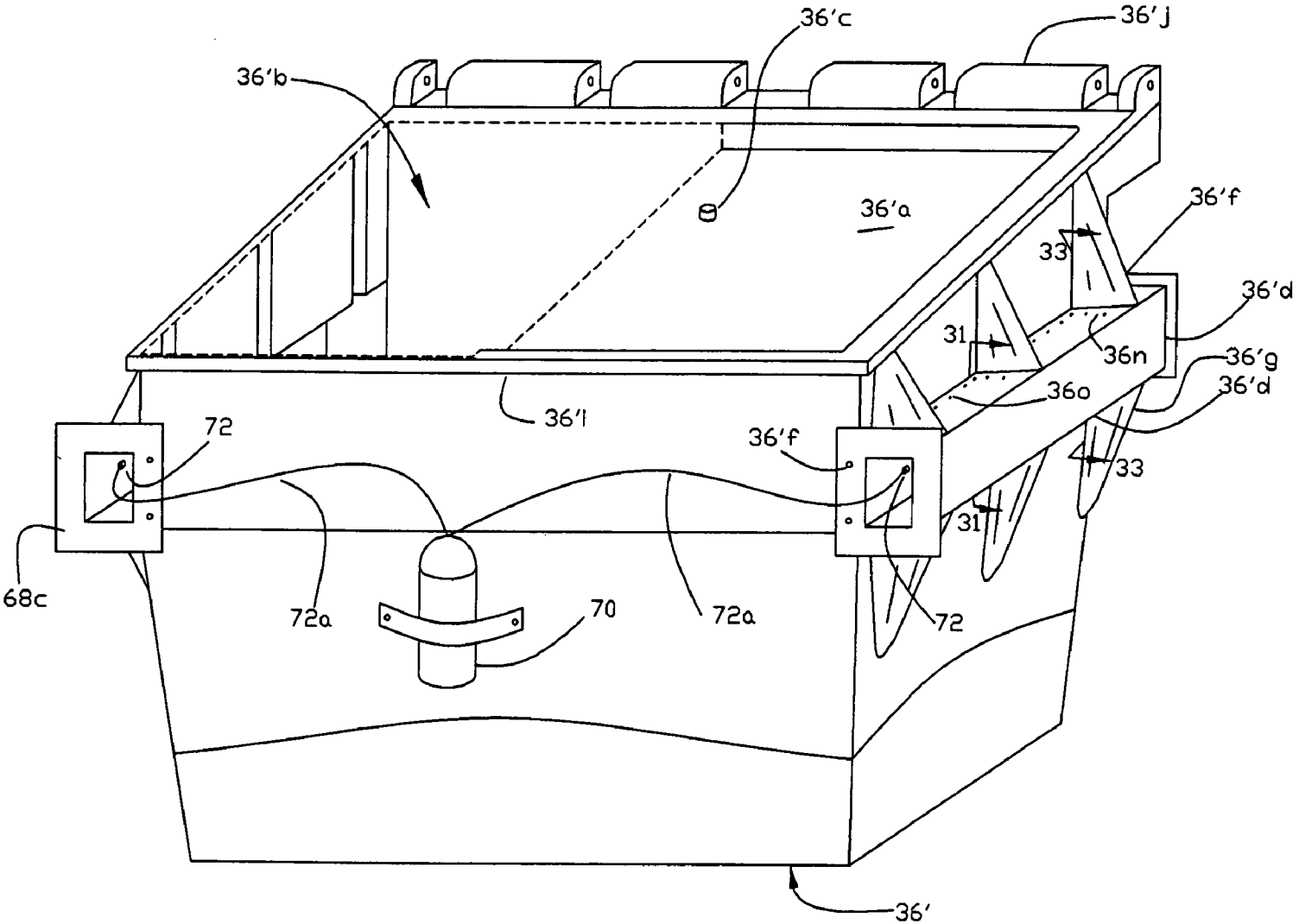
FIG. 29 is a front perspective view of a mold for the container of FIGS. 21-23 with the cover partially removed and a compressed air cylinder secured to the outside of the mold.

A mold 36' for manufacturing the modified container is shown in FIG. 29, which mold is similar to the FIG. 7 mold with suitable modifications to conform to the finished container of FIG. 21 et seq. A removable hollow core 68, formed in two sections 68*a* and 68*b*, is mounted, via flanges 68*c*, to the mold wall by suitable fastening means, such as bolts (not shown), extending through holes 68*d*. See FIG. 30. The 68*b* section is formed with a tapered distal end 68*e* which telescopes into the distal end 68*f* of the 64*a* section.

A compressed air cylinder 70 is mounted on the exterior of the mold. Nozzles 72, connected to the container 70 via lines 72*a*, supply high velocity air to the proximal ends of the removable cores to draw heated air surrounding the mold into the interior of the cores via an eductor action. This provides a more uniformly heated core surface and a more uniform layer of plastic surrounding the cores. Optionally, the cores can be preheated prior to the molding step.

Figure 33:
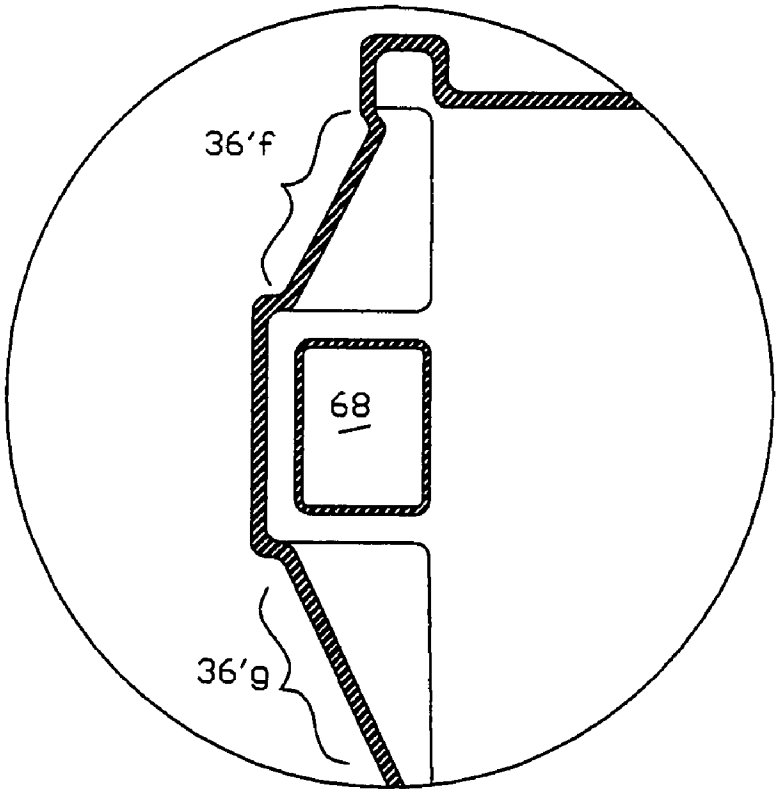
FIGS. 31 and 33 are broken away cross-sectional views of the mold taken along lines 31-31 and 33-33 of FIG. 29, respectively, showing the projections 36*n* adjacent the strut forming mold portions.
Figure 31:
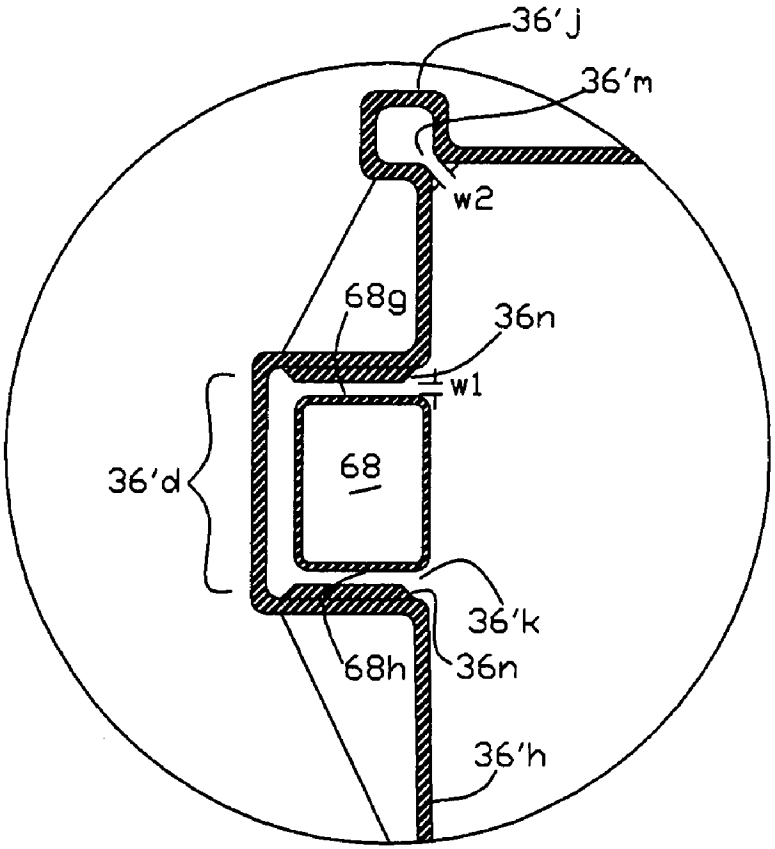
Figure 32:
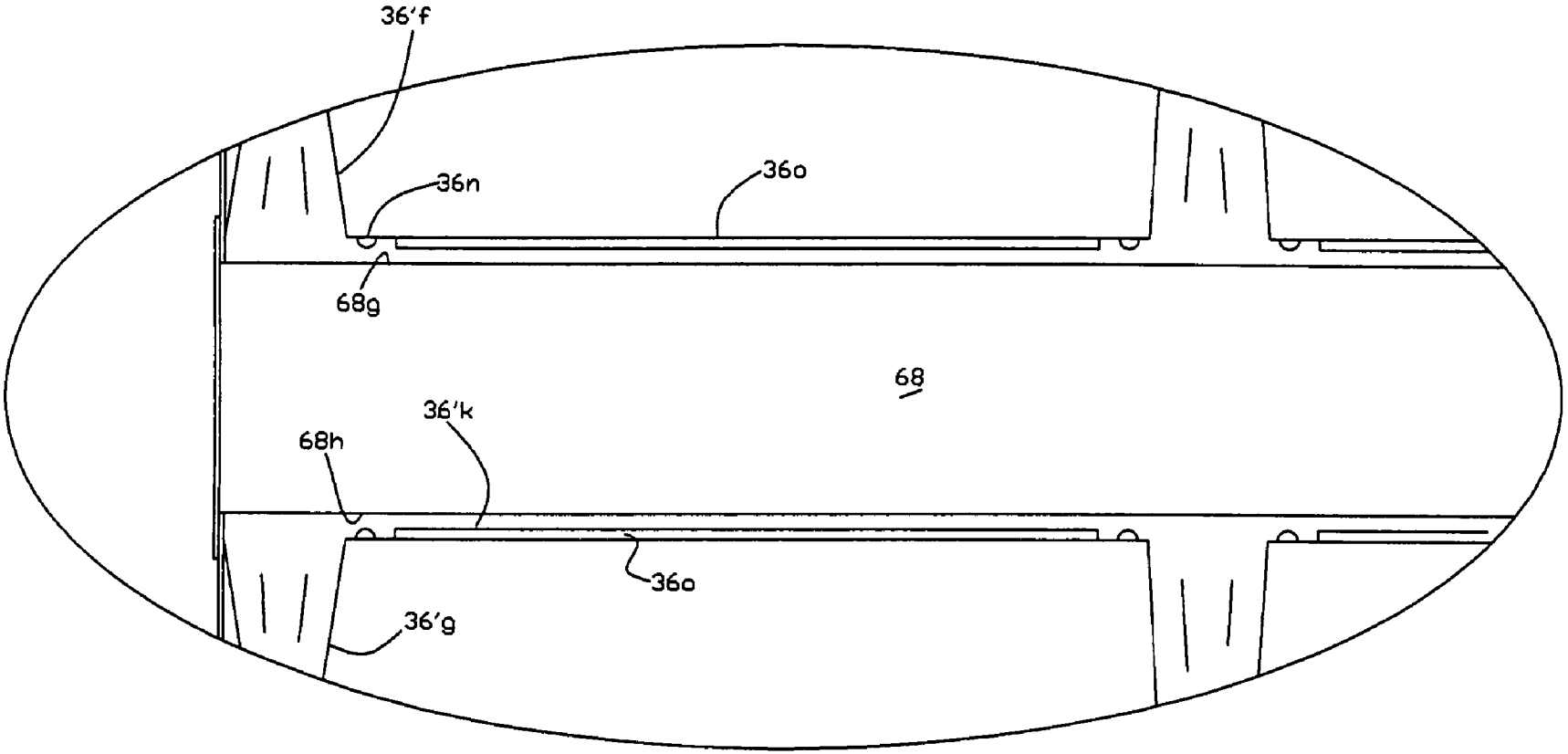
FIG. 32 is a broken away side elevational view of the removable core positioned within the mold showing the projections 36*n* and 36*j* looking from inside the compartment section.

Mold portions 36*n* and 36*o*, which form the container pocket depressions 60 and 62, respectively, are illustrated in FIGS. 31-33. The skirt forming depressions may, as an example, be in the form of rods secured to the mold wall via screws, shown as dots overlying the rods. FIGS. 31 and 33 are cross-sectional views taken along lines 31 and 33 of FIG. 29 with FIG. 31 showing the rod members 36*n*. FIG. 32 is a broken away view of the mold looking at the mold section which forms a portion of one of the container pockets (and skirt strut sections) from inside the mold. The rod members 36*n* and 36*o* (FIG. 32), along with the upper and lower outer surfaces 68*g* and 68*h*, respectively, of the removable core 68, form the gaps w1 while eliminating the need to extend the inner sides of the core. These gaps are bridged over during the manufacturing process as was explained in connection with FIGS. 11 and 12. It is to be noted that the rod members 36*n* and 36*o* may constitute one member or mold portion.

Figure 35:
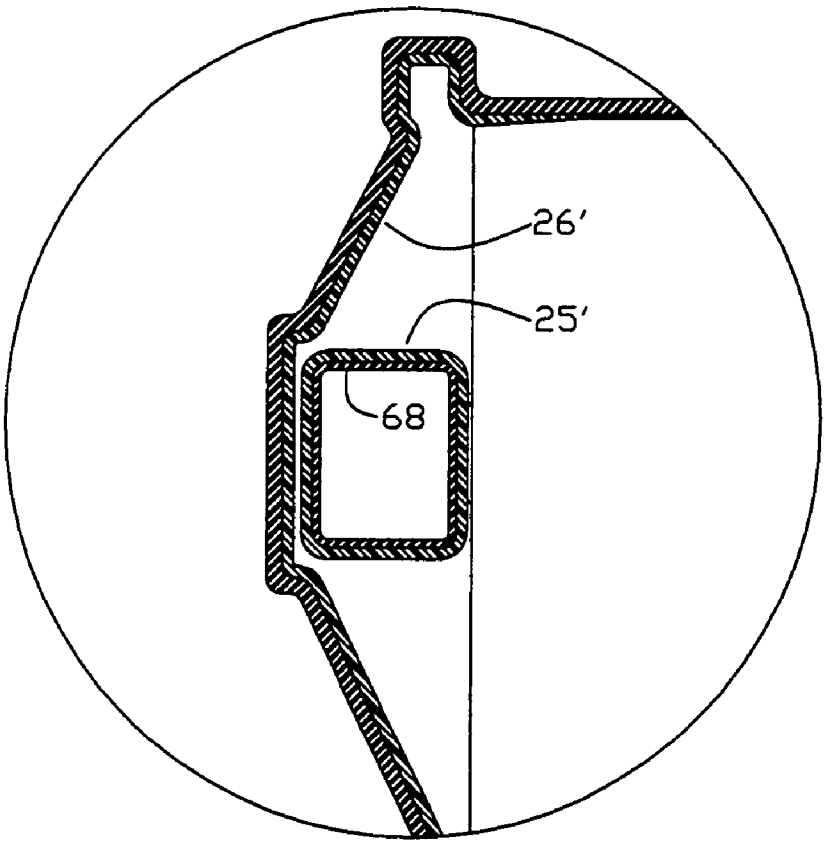
FIGS. 34 and 35 are broken away cross-sectional views of the mold portions shown in FIGS. 31 and 33 with a finished layer of plastic thereon.
Figure 34:
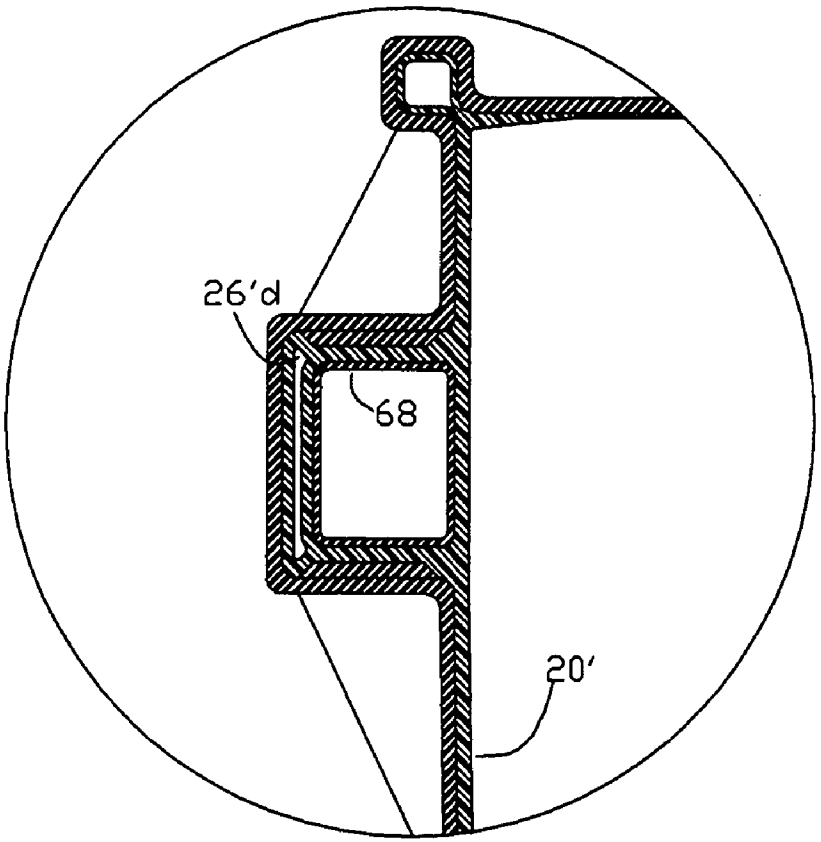

FIGS. 34 and 35, similar to FIGS. 15 and 16, illustrate the finished rectangular pocket 25' and surrounding skirt 26' of the container (within the mold) with the gaps 36'*k* and 36'*m* bridged over. It is to be noted that the void 26'*d* extends only along the back wall of the pocket along the mold portion 36*n*.

Figure 36:
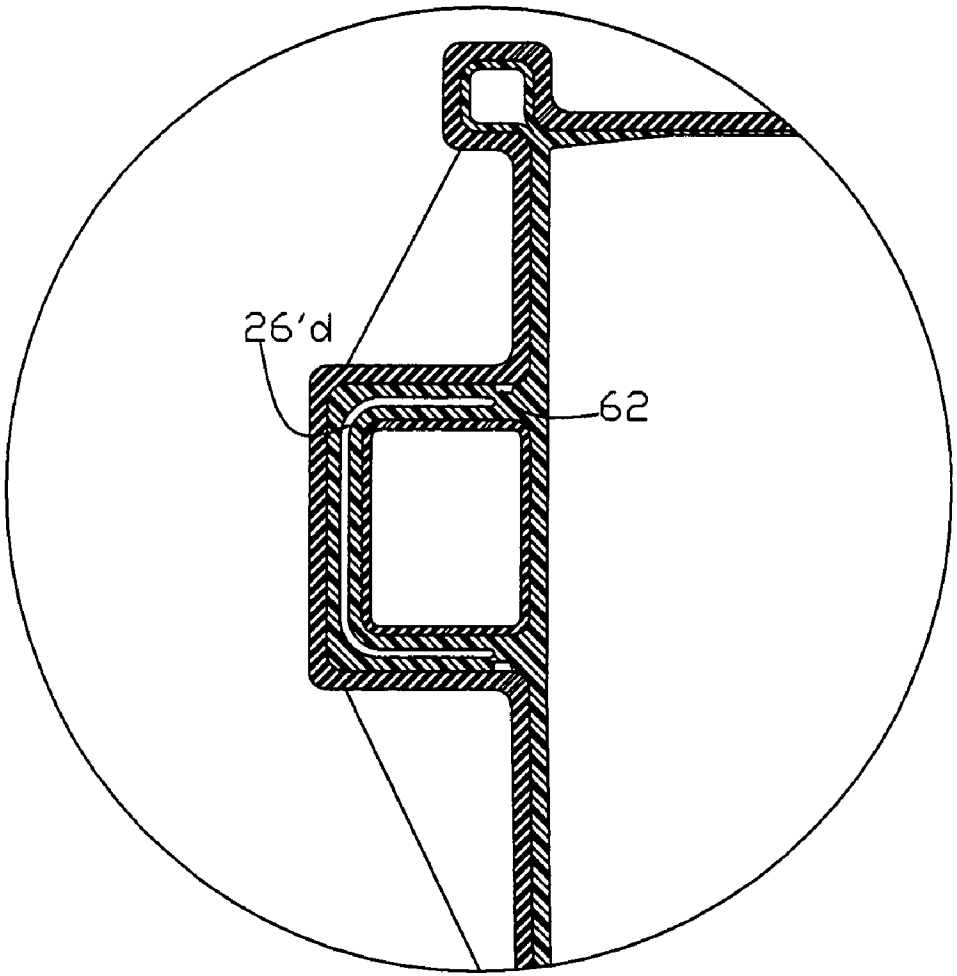
FIG. 36 is a broken away cross-sectional view of the mold portion which forms the skirt c-section taken midway between the skirt strut forming portions with a finished layer of plastic thereon.

FIG. 36, a broken away cross-sectional view of the skirt and pocket forming portion of the mold between the struts, illustrates how the void 26'*d* extends from the back of the pocket up to the mold portion 36*o* in the finished container in this area.

Figure 37:
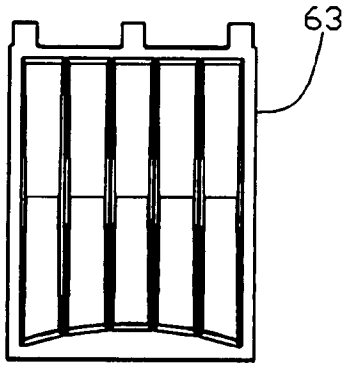
FIG. 37 is a top plan view of one-half of the divided lid.
Figure 30:
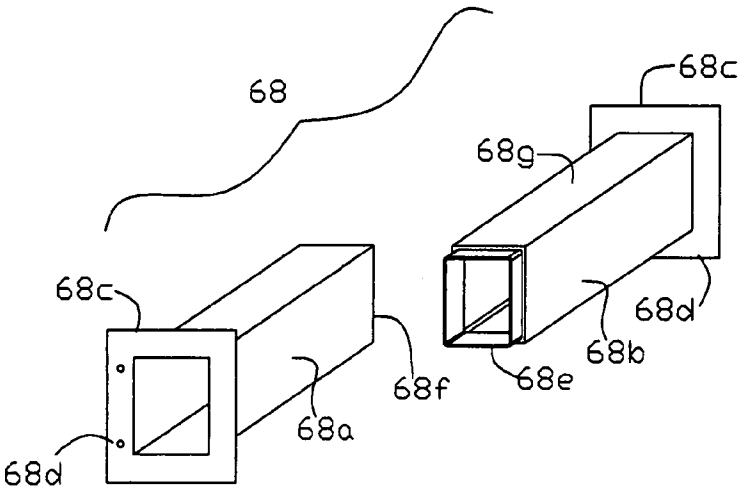
FIG. 30 is a perspective view of a pair of removable core elements to be attached to the mold of FIG. 29.

FIG. 37 illustrates one half of a divided lid as pointed out earlier.

Referring now to FIG. 38, the caster assemblies 66 comprise a bracket 66*a*, preferably made of a high strength material, such as steel, with side plates 66*b* separated by a caster plate receiving cage formed by base plate 66*c*, side walls 66*d*, angle plate 66*e* and a stop plate 66*f*. A shock absorbing layer 66*h*, made, for example, from rubber, may optionally be positioned between the base plate 66*c* and the caster plate 66*g* carrying a swivel caster 66*h*. The caster plate 66*g* is secured within the cage by a bolt 66*i*.

Figure 38B:
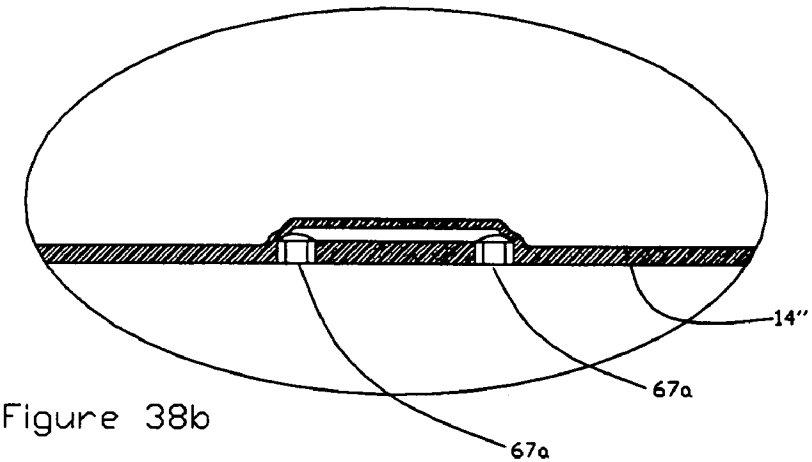
FIG. 38*b* is a broken away cross sectional view of the container bottom wall showing the wire reinforced nuts of FIG. 38*a* in place.
Figure 38A:
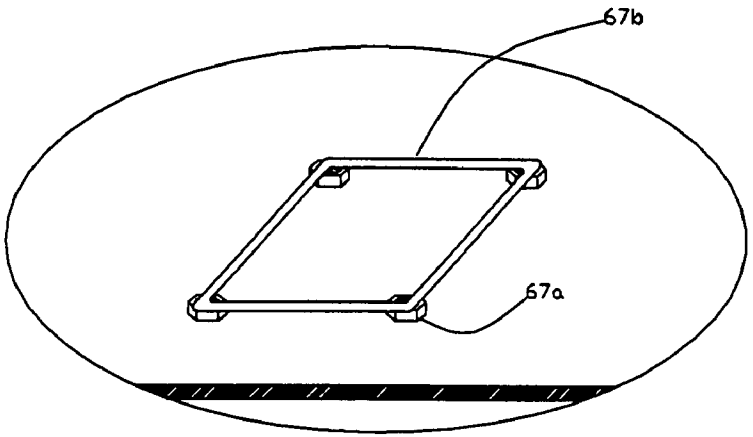
FIG. 38*a* is a broken away perspective view of a modified bottom portion of the mold of FIG. 29 illustrating how wire reinforced caster plate receiving nuts can be encapsulated and molded into the bottom wall of the container.

FIG. 38*a* illustrates a method of modifying portions of the bottom of the mold of FIG. 29 so that nuts 67*a* reinforced by a connecting wire 67*b* welded thereto, can be encapsulated into each corner of the plastic bottom wall of the finished container to accommodate the four casters 66 of FIG. 23. The nuts 67*a* are suitable secured over holes in the mold bottom wall, via bolts, for example. A broken away, cross-sectional view of the finished bottom container wall 14" encompassing the caster bolt receiving nuts and reinforcing wire in the molded plastic is illustrated in FIG. 38*b*. With this embodiment the bracket 66*a* of FIG. 38 need only be provided with four holes through which bolts may be threaded into the encapsulated nuts 67*a*.

Figure 39:
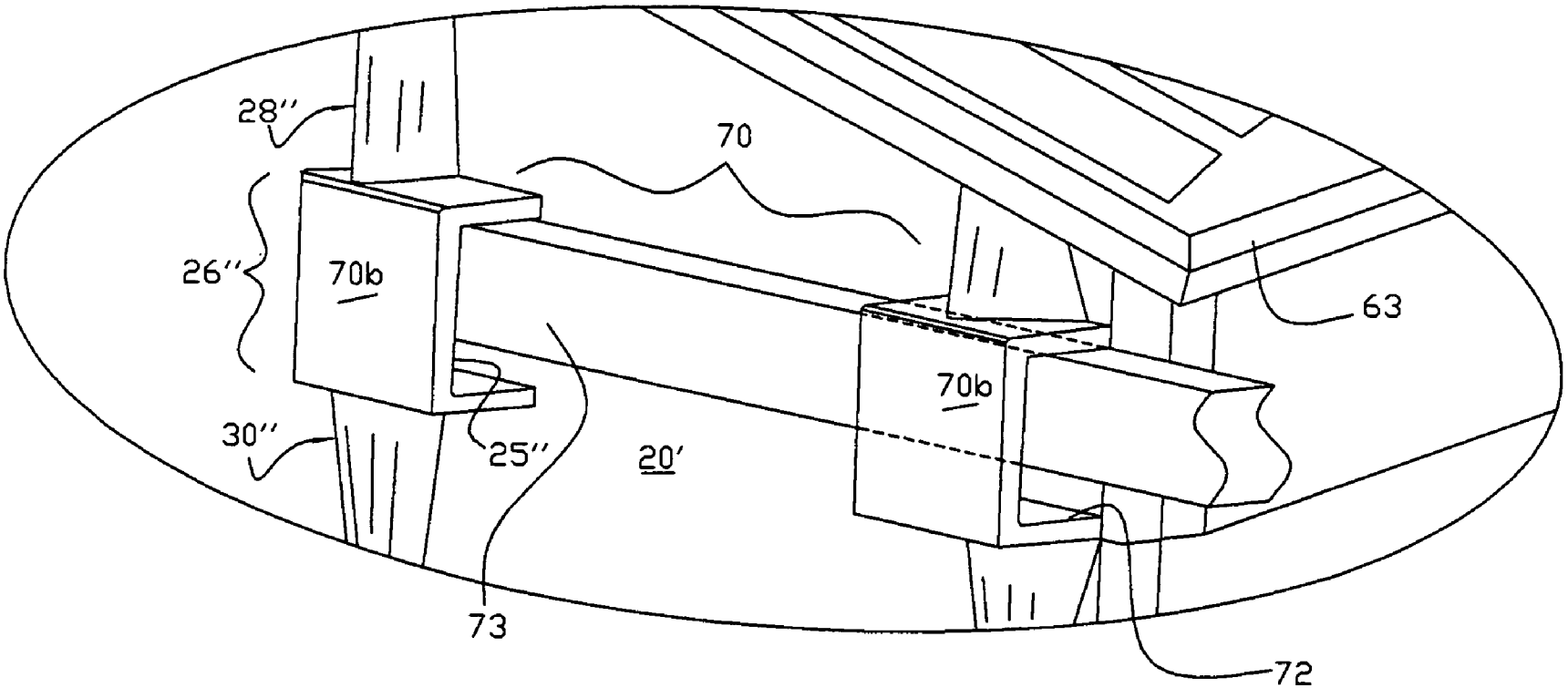
FIG. 39 is a broken away perspective view of another skirt/pocket design with a lifting prong inserted through the channel.

FIG. 39 illustrates a further modification of the container with a split skirt/pocket including a forward portion 70*a* forming the front of an open channel 72 and a rearward portion 70*b* forming the rear of the open channel. Each portion 70*a* and 70*b* is formed with c-shaped skirt sections 26" located on each side of struts 28" and 30" surrounding a pocket 25". A cross section through the skirt strut/pocket and skirt c-section/pocket would appear as shown in FIGS. 26 and 25, respectively. It is to be noted that the indents 60 and 62 in the skirt c-sections are optional. A lifting prong 73 is shown as being inserted through the channel formed by the pocket.

Figure 40:
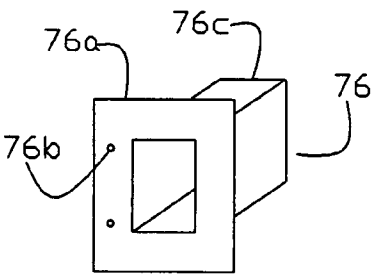
FIG. 40 is a perspective view of a removable core for creating the skirt/pocket arrangement of FIG. 39.

In molding the embodiment of FIG. 39 a removable core 76 (FIG. 40) would be inserted into each split skirt section of the mold and secured thereto via bolts (not shown) through holes 76*a* in flanges 76*b*. A plate (not shown) would extend across the distal end 76*c* of each core to form the distal end of each skirt/pocket in a well known manner. The plastic material formed on such end plates would be trimmed to form the channel 72 within the pockets.

Figure 41:
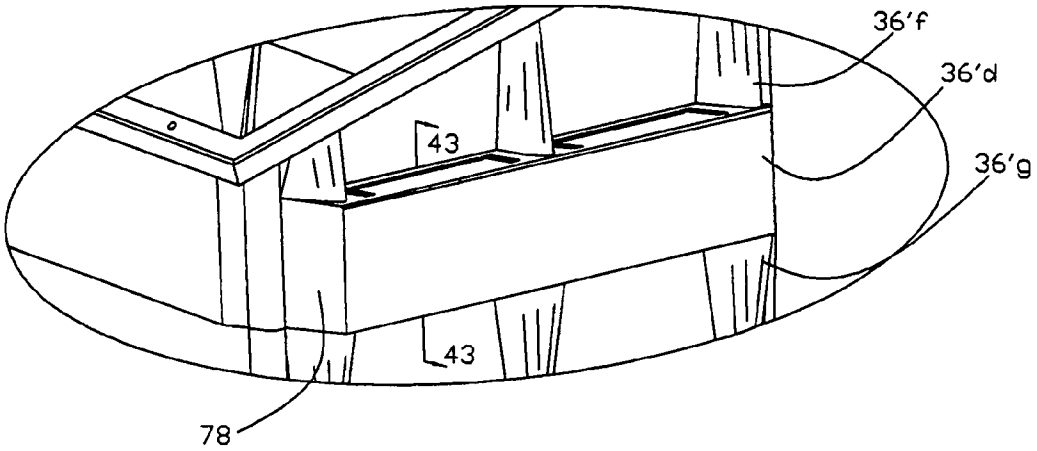
FIG. 41 is a broken away perspective view of the design of an alternative skirt forming portion of a mold.

FIG. 41 illustrates a skirt forming portion of a mold for manufacturing a container in which the c-sections of the skirt are open to the compartment section, i.e., without the insertion of a removable or nonremovable core. In this embodiment the mold includes plates 78 extending over the ends of the open skirt portions to form a wall of plastic at each end of the skirt.

Figure 42:
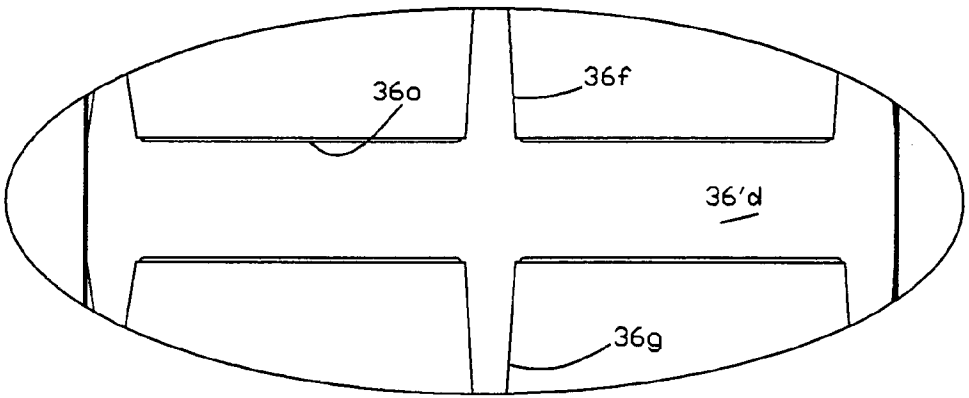
FIG. 42 is a broken away side elevational view of the skirt forming mold portion of FIG. 41 looking from inside the mold compartment.
Figure 43:
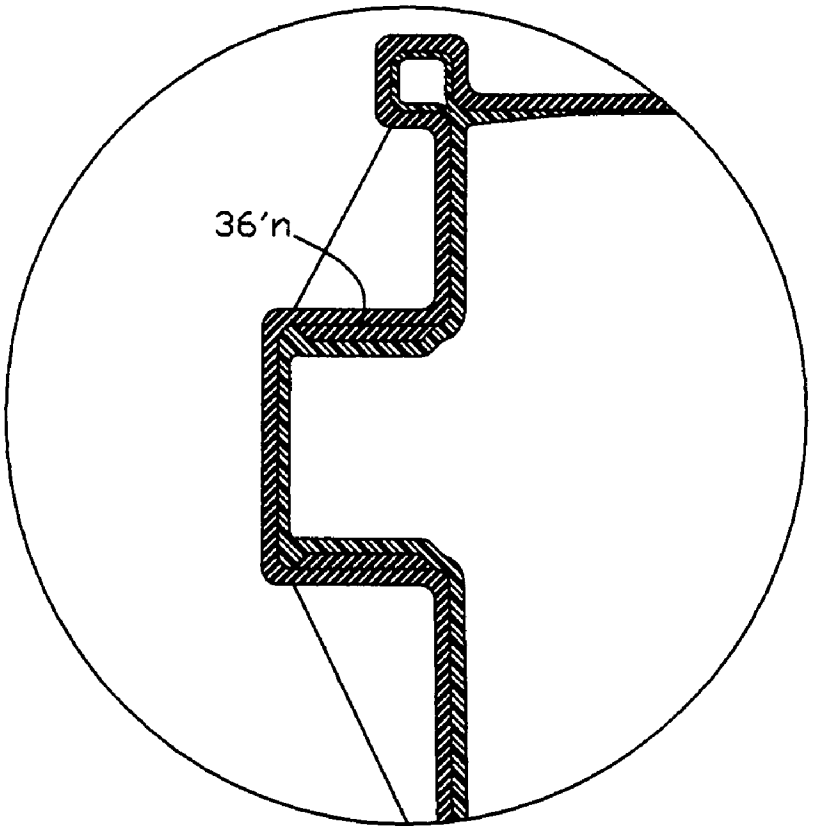
FIG. 43 is a cross-sectional view of the mold skirt forming mold portion taken along lines 43-43 of FIG. 41 with a finished layer of plastic formed therein.

FIG. 42 is a side elevational view of the mold skirt forming portion of FIG. 41 looking from inside the mold. FIG. 43, a cross sectional view taken along lines 43-43 of FIG. 41, during the molding process, shows the finished plastic layer formed on the inner wall of the skirt c-section forming portion of the mold. A plastic layer would also form on the inner wall of the skirt strut forming portions of the mold as illustrated in FIG. 35, without the pocket forming removable core.

Figure 44:
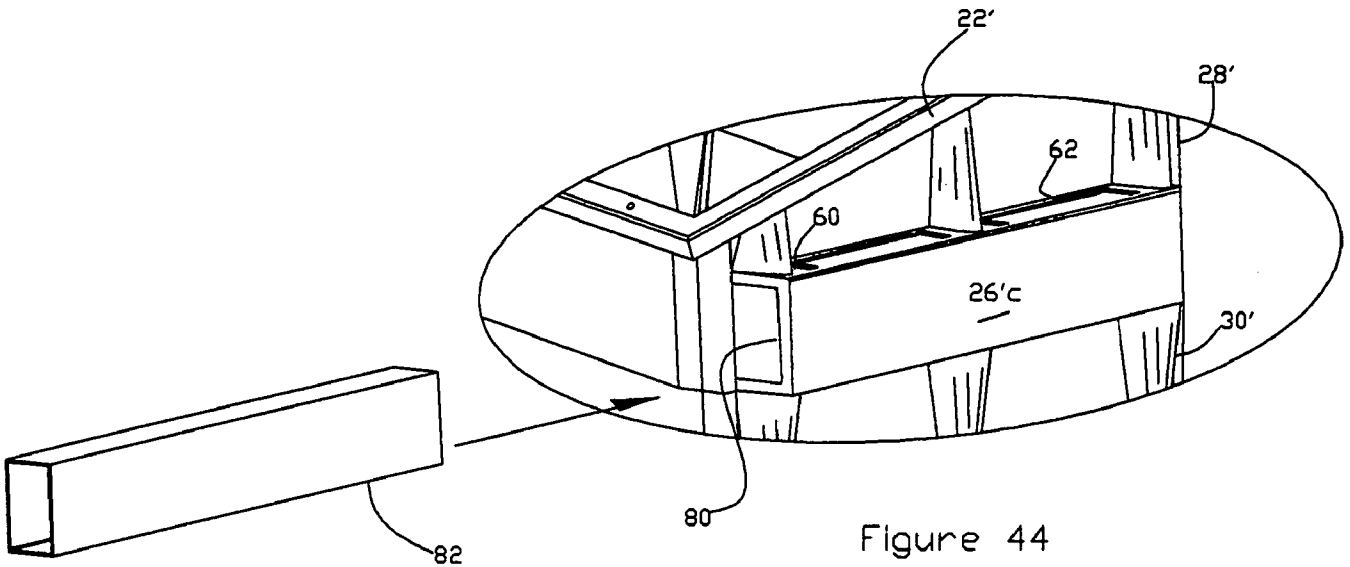
FIG. 44 is a broken away perspective view of a container skirt made with the mold design of FIG. 41 with a pre-molded rectangular sleeve (forming the pocket) arranged to be inserted therein.
Figure 45:
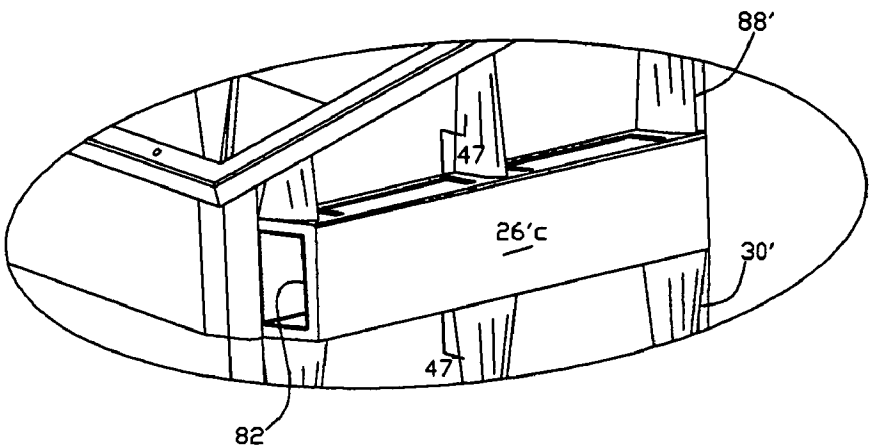
FIG. 45 is a broken way view of the container skirt of FIG. 44 with the pocket forming sleeve in place.

Once the container is removed from the mold of FIG. 41, the ends of the skirt, formed on the inside of the plates 78, are trimmed to form rectangular openings 80 sized to receive a pre-molded plastic sleeve or pocket 82. As is illustrated in FIG. 44, this pre-molded pocket 82 is then inserted through the skirt, with the ends of the pocket being welded to the plastic material framing the openings at the front and rear of the skirt. The resulting container with the inserted pocket in place is shown in FIG. 45.

Figure 47:
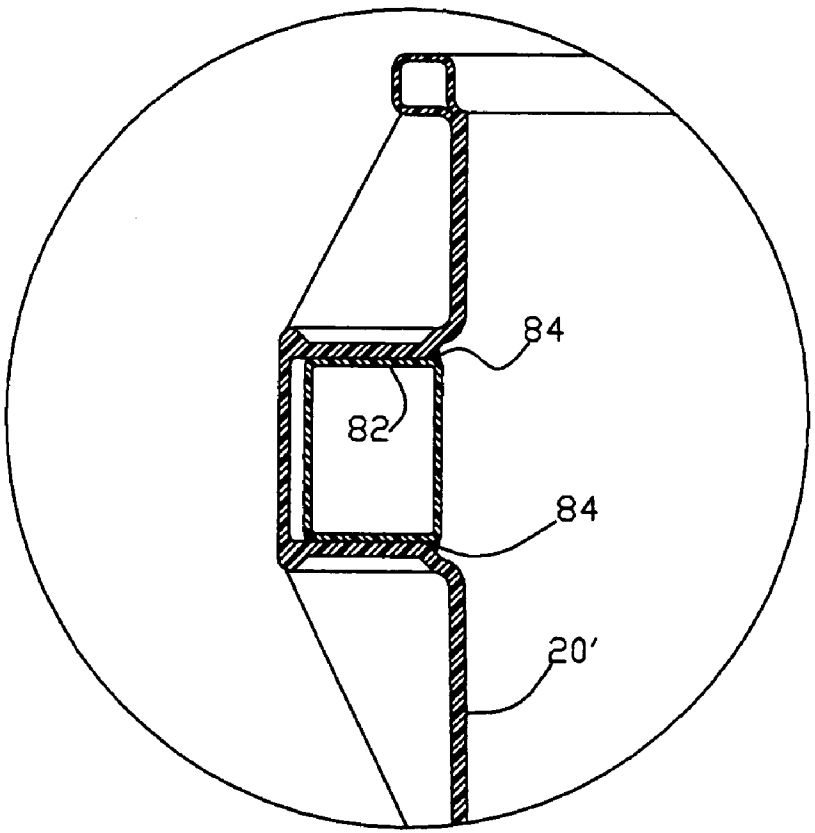
FIG. 47 is a cross-sectional view taken along lines 47-47 of FIG. 45 with the pocket forming sleeve welded in place.

The inserted pocket 82 is also welded at 84 to the interior wall of the skirt c-sections adjacent the inside of the compartment wall 20'. See FIG. 47. The pre-molded plastic pocket is thus integrally formed with the compartment side walls and in conjunction with the skirt and strut sections thereof (if used) are the structural components which support the container and its load within the compartment on the lifting prongs. The term "integrally formed with" as used herein to describe the relationship between the plastic pockets and the container side walls refers to integrally molding the pockets with the compartment or bonding (e.g., by welding) pre-molded pockets to the compartment side walls/skirts.

Figure 48:
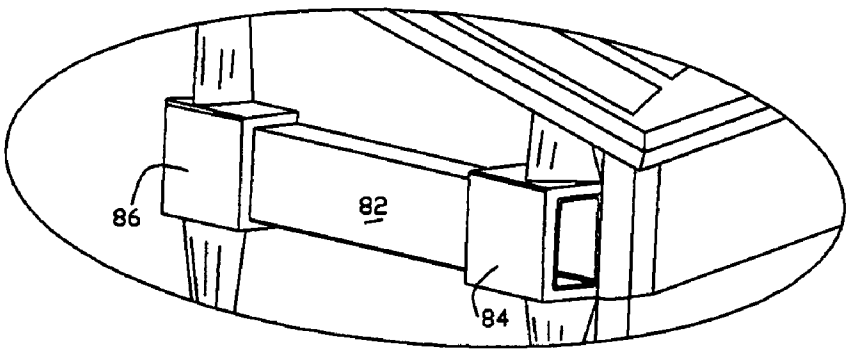
FIG. 48 is a broken away perspective view of an alternative design of a skirt/pocket arrangement in which a pre-molded pocket forming sleeve is inserted to split skirt sections such as those illustrated in FIG. 39.

FIG. 48 illustrates yet another embodiment of a skirt/pocket arrangement for the container in which a pre-molded plastic pocket forming sleeve 82 is inserted into the openings formed by split front and rear skirts 84 and 86, respectively. Again, the ends of the sleeve are welded to the skirt ends and also the inside wall of the compartment adjacent the skirt c-sections.

Figure 49:
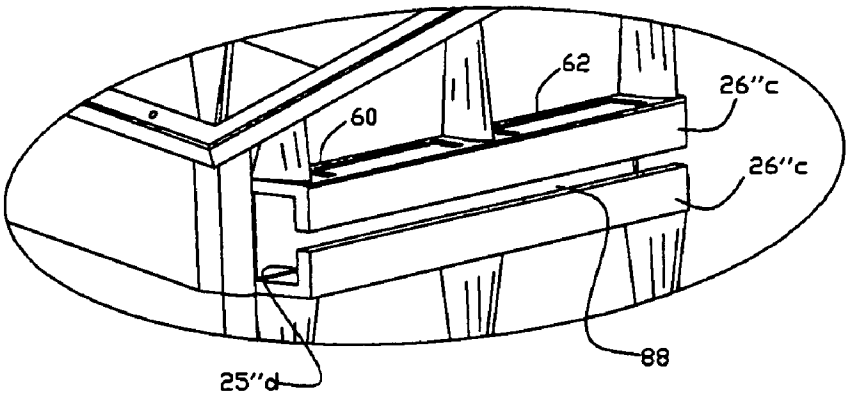
FIG. 49 is a broken away perspective view of another alternative design of a skirt/pocket arrangement providing an elongated slot in the side wall.
Figure 46:
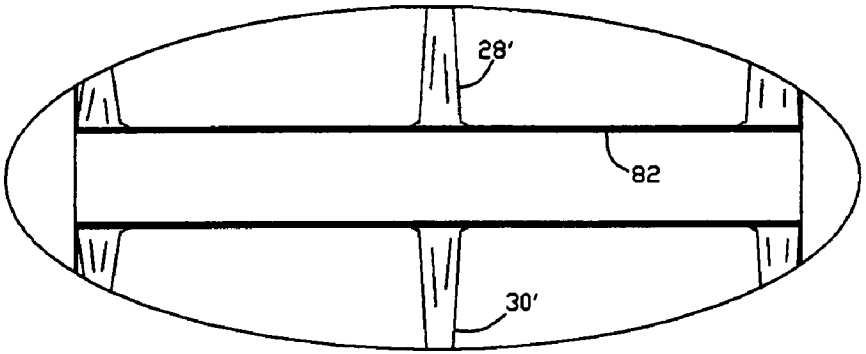
FIG. 46 is a broken away side elevational view of the pocket forming sleeve (82) in the skirt of FIG. 45 looking from inside the container compartment.

FIG. 49 illustrates another modification of a skirt/pocket arrangement in which the common exterior side walls 26"*c* of the skirt and the adjacent outer side wall 25"*d* of the pocket are formed with an elongated slot or opening 88 therein. This modified skirt/pocket can be integrally molded with the compartment by suitably modifying the mold of FIG. 29, i.e., by indenting the side wall 36'*d* of the mold 36 of FIG. 29 to correspond to the configuration of the slot.

A novel rotationally molded waster container and method of fabricating the same has been described. While the container described herein has been designed to receive waste products it should be noted that the invention is independent of the materials which are stored in or removed from the container. It should also be noted that modifications to the container and method as described herein will occur to those skilled in the art without involving any departure from the spirit and scope of our invention as defined in the appended claims.

What is claimed is:

1. A molded plastic waste container adapted to be lifted by spaced apart prongs of a lifting mechanism comprising:

a. a compartment having a bottom member, a rear and front wall and a pair of opposing side walls, said member and walls being integrally molded as a unit and forming a rim at their peripheries to define at least one container opening into said compartment;

b. a pocket along each of said opposing side walls monolithically molded of the same material as the side walls and having at least one opening juxtaposed with one of said front or rear walls, said pocket dimensioned to accept said prongs of a lifting mechanism;

c. at least two spaced apart struts on each of said opposing side walls extending from substantially said rim to a point on the associated side wall below said pocket, each of said stuts encompassing an associated pocket for support thereof; and d. at least one skirt comprising three walls monolithically molded with each side wall and extending between associated struts and over said respective pocket, said struts and skirt comprising a common wall where said strut is juxtaposed with said pocket.

2. The container as set forth in claim 1 wherein said skirts further comprise a plurality of c-sections and a plurality of struts positioned adjacent said skirts.

3. The container as set forth in claim 1 wherein said skirts each comprise a c-section having three walls common with an associated pocket, said pocket having a noncommon wall comprising a respective compartment side wall.

4. The container as set forth in claim 3 wherein an outer wall of said c-section is spaced apart from said pocket wall opposite from said noncommon wall.

5. The container as set forth in claim 4 wherein each of said c-sections comprises a mold interface at said noncommon wall.

6. The container as set forth in claim 1 includes integrally formed hinge ears along said rim forming a portion of said container opening periphery, said ears each including an opening therethrough to receive a hinge pin to secure at least one openable lid means to cover said container opening.

7. The container as set forth in claim 6 wherein said container includes at least one lid means covering said opening in the compartment, said lid means being pivoably attached to said hinge ears.

8. The container as set forth in claim 3 wherein said outer wall of said c-section is integrally molded with said pocket wall opposite from said noncommon wall.

9. The container as set forth in claim 8 wherein said rim includes integrally formed hinge ears along said rear wall, said ears each including an opening therethrough to receive a hinge pin to secure at least one openable lid means.

10. The container as set forth in claim 9 wherein said container includes at least one lid means covering said opening in the compartment, said lid means being pivoably attached to said hinge ears.

11. The container set forth in claim 1 wherein said pockets extend along said respective side wall from said front to said rear wall.

12. The container set forth in claim 1 wherein each of said pockets are open at their respective ends.

13. The container as set forth in claim 1 wherein said bottom includes at respective corners of the compartment a caster.

* * * * *